US010347117B1

(12) United States Patent
Capurro

(10) Patent No.: US 10,347,117 B1
(45) Date of Patent: Jul. 9, 2019

(54) PORTABLE ALERT COMMUNICATION SYSTEM

(71) Applicant: Jennifer L. Capurro, Santa Rosa, CA (US)

(72) Inventor: Jennifer L. Capurro, Santa Rosa, CA (US)

( * ) Notice: Subject to any disclaimer, the term of this patent is extended or adjusted under 35 U.S.C. 154(b) by 0 days.

(21) Appl. No.: 14/871,922

(22) Filed: Sep. 30, 2015

Related U.S. Application Data

(60) Provisional application No. 62/059,349, filed on Oct. 3, 2014.

(51) Int. Cl.
*G08B 27/00* (2006.01)
*A61G 12/00* (2006.01)

(52) U.S. Cl.
CPC ..... *G08B 27/00* (2013.01); *A61G 12/00* (2013.01)

(58) Field of Classification Search
CPC ..... A61G 12/00; A61G 1/00; A61G 11/00; A47B 31/00; G08B 5/22
USPC ..... 340/286.07
See application file for complete search history.

(56) References Cited

U.S. PATENT DOCUMENTS 5,867,821 A 2/1999 Ballantyne et al.
5,877,675 A 3/1999 Rebstock et al.
6,915,170 B2 7/2005 Engleson et al.
6,958,706 B2 10/2005 Chaco et al.
7,042,237 B2 5/2006 Borders et al.
7,451,096 B2 11/2008 Rucker
7,746,218 B2 6/2010 Collins et al.
8,180,650 B2 * 5/2012 Graves ..... G01V 15/00 705/2
8,384,526 B2 2/2013 Schuman et al.
8,456,286 B2 6/2013 Schuman et al.
9,185,202 B2 * 11/2015 Herbst ..... H04M 1/72541
2006/0049936 A1 * 3/2006 Collins, Jr. ..... A61B 5/1115 340/539.11
2007/0194939 A1 * 8/2007 Alvarez ..... A61B 5/0002 340/573.1
2009/0212956 A1 * 8/2009 Schuman ..... G08B 5/222 340/573.1
2011/0050411 A1 3/2011 Schuman et al.
2014/0085082 A1 * 3/2014 Lyon ..... A61B 5/746 340/539.12

(Continued)

*Primary Examiner* — Omar Casillashernandez
(74) *Attorney, Agent, or Firm* — Jay P. Hendrickson

(57) ABSTRACT

A portable alert communication system for use in a health care facility comprising a local display device for use by a healthcare administrator, with the local display device having a level-of-care mechanism, a display screen, and an acknowledgment indicator; and a remote display device for use by a healthcare provider, with the remote display device having a level-of-care indicator and an acknowledgment mechanism; and whereby the healthcare administrator can use the local display device to send a level-of-care alert relating to the needs of a patient to the remote display device, which can display the level-of-care alert to the healthcare provider, who can then use the acknowledgement indicator to send an acknowledgment response to the local display device, which can use the acknowledgment indicator to display the acknowledgment response from the healthcare provider to the healthcare administrator, indicating whether the healthcare provider accepts or declines the healthcare administrator's request to attend to the needs of the patient.

13 Claims, 15 Drawing Sheets

(56) References Cited

U.S. PATENT DOCUMENTS

2015/0312533 A1* 10/2015 Moharir ..... G06F 19/3425
348/14.02

* cited by examiner

PORTABLE ALERT COMMUNICATION SYSTEM

PRIORITY

This application relates to and claims the benefit under 35 U.S.C. § 119(e) of U.S. Provisional Application No. 62/059,349 filed on Oct. 3, 2014.

FIELD OF THE INVENTION

The portable alert communication system relates to alert communication systems and, more specifically, to alert communication systems used in healthcare facilities and educational facilities.

BACKGROUND OF THE INVENTION

Alert communication systems currently in use at hospitals and other healthcare facilities are essentially local telephone systems for use by a hospital administrator in making telephone-like calls to healthcare providers within the facility concerning the healthcare needs of a patient. The system typically includes a stationary telephonic device for use by the healthcare administrator, who has the responsibility of responding to a patient's request for assistance. Normally, the patient can contact the healthcare administrator by using a communication device located at the patient's bedside, with the communication device telephonically connected to the administrator's telephonic device. During the ensuing oral communication between the patient and hospital administrator, the administrator can ascertain, for example, what level-of-care the patient needs, in terms of what type of care the patient needs and whether that care is needed immediately, as soon as practical or somewhere in between.

Once the healthcare administrator has determined the nature of the patient's request, and its urgency, the administrator can use the stationary telephonic device to call, for example, the patient's nurse by dialing the telephone phone number that is associated with a mobile telephonic device, ostensibly carried by the nurse. The nurse's telephonic device alerts the nurse of the call by sounding an audible ring tone. If the nurse answers the call, the two parties can discuss the healthcare needs of the patient and determine if the nurse can timely respond to the patient's needs. In many instances, however, the healthcare administrator's call occurs while the nurse is currently attending to the needs of another patient. This circumstance creates a serious dilemma for the nurse. Should the nurse simply ignore the call and continue attending to the needs of the patient or should the nurse stop providing care and engage in a conversation with the healthcare administrator to find out what are the needs of the other patient who is requesting assistance. If the nurse decides to ignore the call from the healthcare administrator, the nurse is potentially putting the healthcare needs of the current patient above the needs of the other patient asking for help, without knowing what that other patient's healthcare needs are. And, the ringing telephonic device, even if it is turned off after a few rings, can be disruptive to the current patient, who may be sleeping or otherwise physiologically vulnerable to disruptions. The ringing telephonic device can also contribute to "alarm fatigue", a well known psychological phenomena in hospitals in which nurses can become desensitized to all of the different alarms that can sound in a hospital environment, like beeping sounds from cardiac monitors, intravenous systems and patient controlled anesthesia pumps. As a result of this desensitization, there exists an increased likelihood that an important or critical emergency condition will go unnoticed by the nurse. In addition, after the telephonic device is turned off, the nurse must remember to turn it back on, lest he or she miss another potentially urgent call from the healthcare administrator. When the call is not answered, the healthcare administrator must decide whether to take the time to try calling the nurse back, hoping that the call will be answered. If the call is ultimately not answered, the healthcare administrator would then need to start calling other nurses until one of them answered the call, with each call increasing the delay in providing the patient with potentially urgently needed assistance.

On the other hand, if the nurse answers the call from the healthcare administrator, the nurse is, at least temporarily, giving the other patient's healthcare needs priority over his or her current patient, again without knowing what the other patient's healthcare needs are. Further, the decision to take time to answer the call and talk to the administrator can potentially cause a disruption to the intimate relationship between the current patient and nurse due to the appearance, real or not, that the current patient is not as important to the nurse as the other patient. Since it is well known that an intimate relationship between patient and caregiver can provide the patient with, at least, a therapeutic sense of wellbeing and may even contribute to a more favorable outcome for the patient, any disruption in that relationship can be deleterious for the patient.

Another limitation of existing healthcare communication systems relates to the situation in which the healthcare administrator is attempting to contact a nurse who is in a hospital isolation room. Before entering an isolation room, the nurse must be gowned and gloved in order to maintain sterile conditions. Prior to being gowned, the nurse must either place the telephonic device in a pocket in the nurse's uniform or leave it outside the isolation room so that the device does not become a source of contamination. If the telephonic device is left outside of the isolation room and the hospital administrator places a call to the nurse's device, the nurse will not normally be able to leave the room to answer the call, assuming the call is audible, unless he or she is re-gowned after answering the call and before re-entering the isolation room. If the telephonic device is left in a pocket of the nurse's nurse uniform, the nurse will not be able to retrieve the device to answer a call without contaminating the isolation room. The practical effect of these two scenarios is that the nurse will, in all likelihood, not answer the hospital administrator's call for patient assistance, again leaving the administrator in a quandary of not knowing whether to keep trying or start calling another nurse.

Yet another limitation of existing healthcare communication systems is that the system administrators operate stationary telephonic devices in order to contact the healthcare providers. This feature constrains the system administrators to their station. As a result, if the administrator needs to leave the station temporarily, ideally he or she must make sure that someone else, who is competent to respond to patients' needs for assistance, is able to perform that function. If no one else is available, the administrator may have to leave the station uncovered and the potential needs of patients unmet.

In addition to the telephonic alert communication systems, the alert communication systems currently in use in hospitals and other healthcare facilities may include the feature using an audio loudspeaker system throughout the hospital to broadcast emergency alerts that are related to a life threatening condition being experienced by a patient.

These alerts are usually referred to as Code Blue alerts or emergencies. When a Code Blue alert is broadcast, an audible voice announces "Code Blue" over the loudspeaker system and at the same time typically announces the general location of the patient who is experiencing the life threatening condition, such as "East Wing, Second Floor". The precise location is not broadcast in order to comply with HIPPA privacy regulations and in order to avoid unnecessarily upsetting the patient or patient's family who may be in the hospital visiting. Rather, as soon as the Code Blue alert is issued, a hospital staff member has the responsibility to proceed to the elevators providing access to the floor, and as healthcare providers, who are responding to the Code Blue alert, exit the elevators, the staff member verbally informs them of the patient's location.

Although the Code Blue broadcast system is generally effective in marshalling the healthcare providers who may be needed to save the patient's life, the system has several imitations that impact how quickly the patient receives the urgently needed assistance. In addition to broadcasting a loud alarm, another limitation is that healthcare providers cannot respond if they in are in a part of the hospital facility where there is no loudspeaker. Another limitation is that directions to the precise location of the patient must be provided by a staff member, who may be delayed in responding or may not respond due to a failure to hear the alert. This will of necessity cause a delay in being able to treat the patient; potentially loosing valuable time that could cause the patient to lose his or her life.

In addition to a hospital broadcasting alerts related to a patient's life threatening condition, educational facilities, like grade schools, high schools and colleges, must at times warn teachers and students of a potentially life threatening emergency. The situation is all too familiar today in which an armed intruder enters a school with the intent to kill or harm students and teachers and then starts shooting them at random. Most schools have a public address system that could be used by school administrators to issue an alert of the emergency and to verbally announce the emergency measures that should be taken by teachers and students. Unfortunately, however, it is often the case that the school administrator may not learn of the emergency until a substantial amount of harm has been inflicted on the teachers and students. Furthermore, a broadcast of the potential threat to the entire school population may create an unnecessary panic among students, impairing the ability of teachers to implement procedures to protect the students.

The portable alert communication system described below overcomes these and other limitations in existing healthcare and educational alert communication systems.

SUMMARY OF THE INVENTION

A portable alert communication system is presented for use in a healthcare facility, in which the portable alert communication system comprises: a local display device for use by a healthcare administrator; at least one remote display device in communication with the local display device, with the at least one remote display device for use by a healthcare provider; at least one level-of-care mechanism integral with the local display device, with the at least one level-of-care mechanism for use by the healthcare administrator in sending a level-of-care signal to the at least one remote display device, and with the level-of-care signal for use by the at least one remote display device in displaying a level-of-care alert to the healthcare provider related to the needs of a patient; a display screen integral with the local display device, with the display screen for use by the healthcare administrator in entering an identification code that can be used to address the level-of-care signal to be sent to the at least one remote display device; an acknowledgment indicator integral with the local display device, with the acknowledgment indicator for use in displaying an acknowledgment response relating to an acknowledgment signal received from the at least one remote display device; a level-of-care indicator integral with the remote display device, with the level-of-care indicator for use in displaying the level-of-care alert received by the at least one remote display device from the local display device; and an acknowledgment mechanism integral with the at least one remote display device, with the acknowledgment mechanism for use by the healthcare provider in sending the acknowledgment signal to the local display device, and with the acknowledgment signal for use by the local display device in displaying the acknowledgment response indicating whether the healthcare provider can attend to the needs of the patient; whereby the healthcare administrator can use the local display device to send the level-of-care alert relating to the needs of a patient to the at least one remote display device, which can display the level-of-care alert to the healthcare provider, who can then send the acknowledgment response to the local display device, which can display the acknowledgment response to the healthcare administrator, indicating whether the healthcare provider accepts or declines the healthcare administrator's request to attend to the needs of the patient.

A portable alert communication system is also presented for use in a facility, in which the portable alert communication system comprises: a local display device for use by a local person; at least one remote display device in communication with the local display device, with the at least one remote display device for use by a remote person; at least one emergency code mechanism integral with the local display device, with the at least one emergency code mechanism for use by the local person in sending a local signal to the at least one remote display device; a display screen integral with the local display device, with the display screen for use in displaying a remote emergency alert related to a remote signal received from the at least one remote display device; at least one emergency code mechanism integral with the at least one remote display device, with the at least one emergency code mechanism for use by the remote person in sending the remote signal to the local display device and to other remote display devices; and a display screen integral with the at least one remote display device, with the display screen for displaying a local emergency alert related to the local signal received from the local display device and for displaying a remote emergency alert related to another remote signal received from another remote display device; whereby the local person can use the local display device to send the local emergency alert to the at least one remote display device, with the at least one remote device for displaying the local emergency alert to the remote person, and whereby the remote person can use the at least one remote display device: to send the remote emergency alert to the other remote display devices, with the other remote display devices for displaying the local emergency alert to corresponding local persons; and to send the remote emergency alert to the local display device, with the local display devices for displaying the remote emergency alert to the local person.

DETAILED DESCRIPTION

Healthcare Facility

Figure 1A:
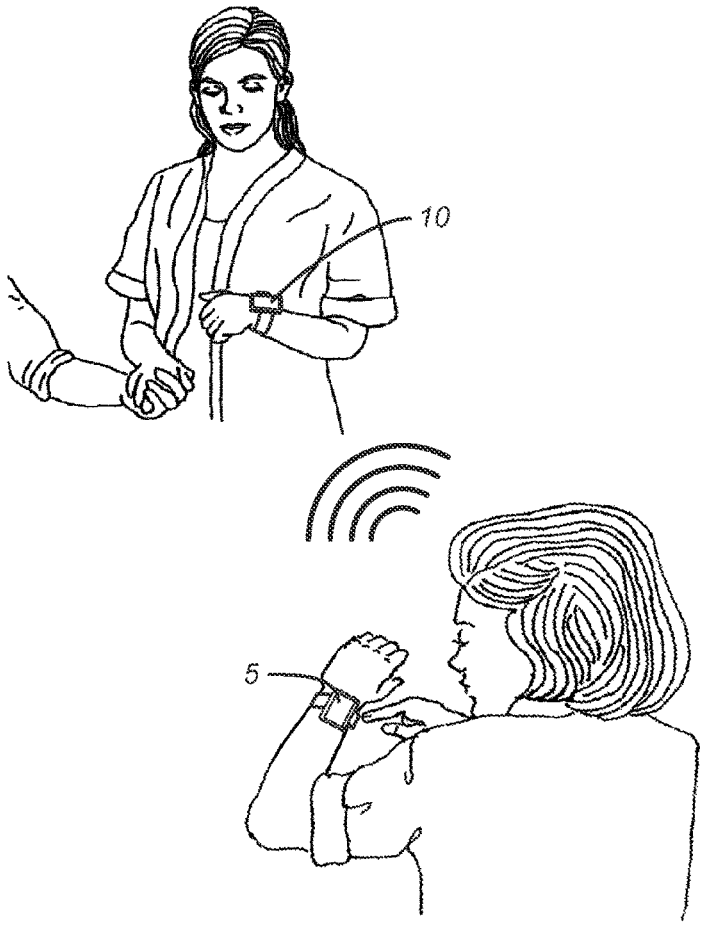
FIG. 1A presents a pictorial representation of a healthcare administrator, who is wearing a local display device that can be being used to wirelessly communicate with a remote display device worn by a healthcare provider.
Figure 1B:
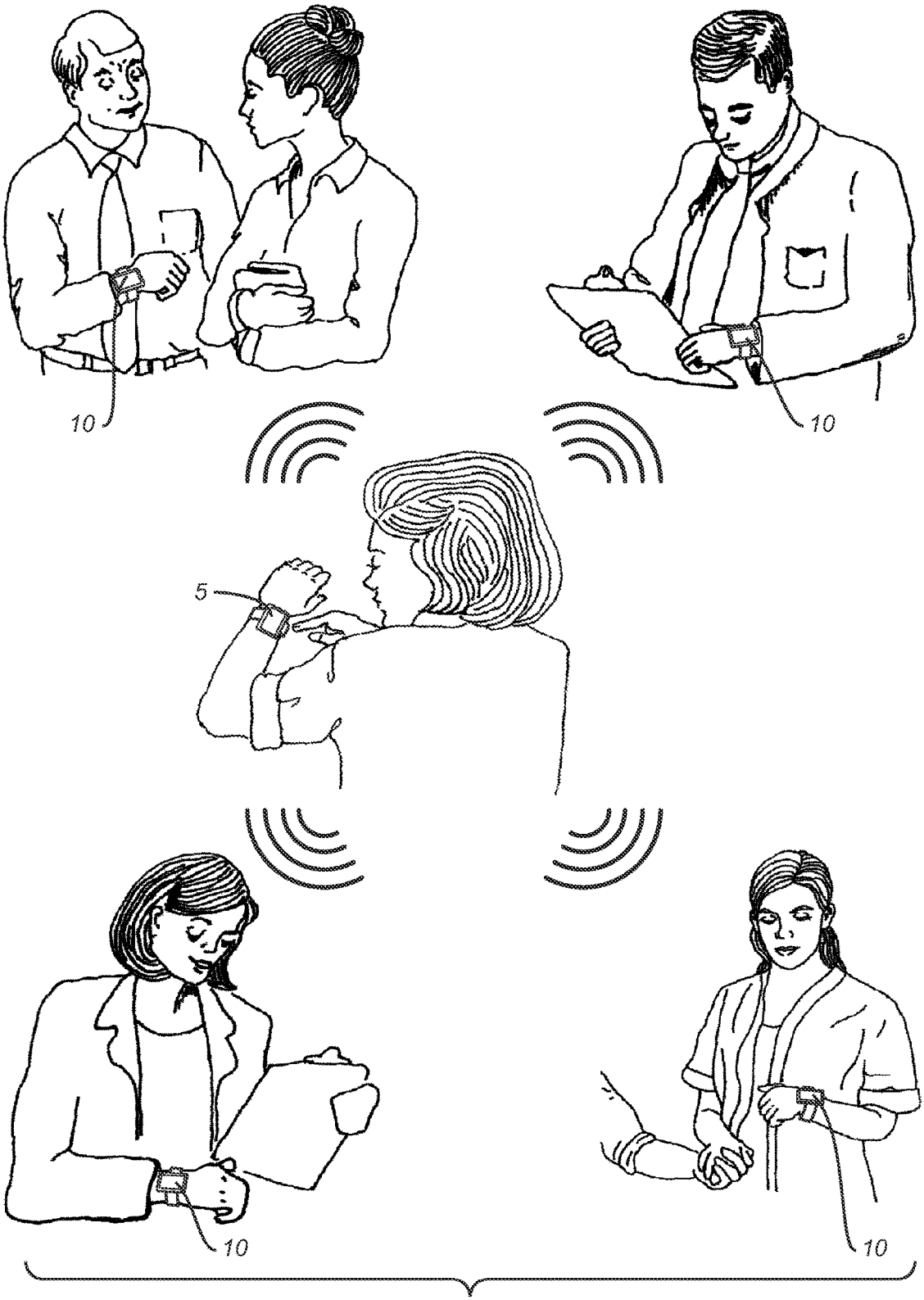
FIG. 1B presents a pictorial representation of a healthcare administrator, who is wearing a local display device that can be being used to wirelessly communicate with a plurality of remote display devices worn by a corresponding plurality of healthcare providers.

FIG. 1A pictorially illustrates a preferred embodiment of a portable alert communication system for use in a healthcare facility, like a hospital, medical clinic, or nursing home. The portable alert communication system is comprised of a local display device 5 that can be worn and used by a healthcare administrator to communicate an alert to a healthcare provider who is wearing a remote display device 10, concerning the healthcare or safety of a patient. Alternatively, the local display device 5 can be a display device that is not worn on the wrist of the health care administrator; for example, the local display device 5 can be a desktop display device having the same functionality as the local display device 5. The healthcare administrator can typically be a person trained in the management of providing healthcare services to patients within a healthcare facility, and the healthcare provider can normally be a doctor, nurse or patient care technician. Preferably, the local display device 5 can be worn on the wrist of the healthcare administrator and the remote display device 10 can be worn on the wrist of the healthcare provider. The local display device 5 and the remote display device 10 can function as two-way communication devices between a healthcare administrator, wearing the local display device 5, and a healthcare provider, wearing the remote display device 10, with communications to a particular station addressed with a unique identification code. Preferably, all communications can be transmitted as wireless communications using radio wave frequencies. And, although the FIG. 1A illustrates a single remote display device 10 being worn on the wrist of a healthcare provider who is providing care to a patient, the portable communication system includes, as shown in FIG. 1B, the potential for the healthcare administrator, wearing local display device 5, to communicate with each healthcare provider out of a plurality of healthcare providers who is wearing the remote display device 10. In order to extend the reach of the wireless communication system between the healthcare administrator and all healthcare providers, a plurality of repeater booster routers can be provided within the healthcare facility.

Figure 2:
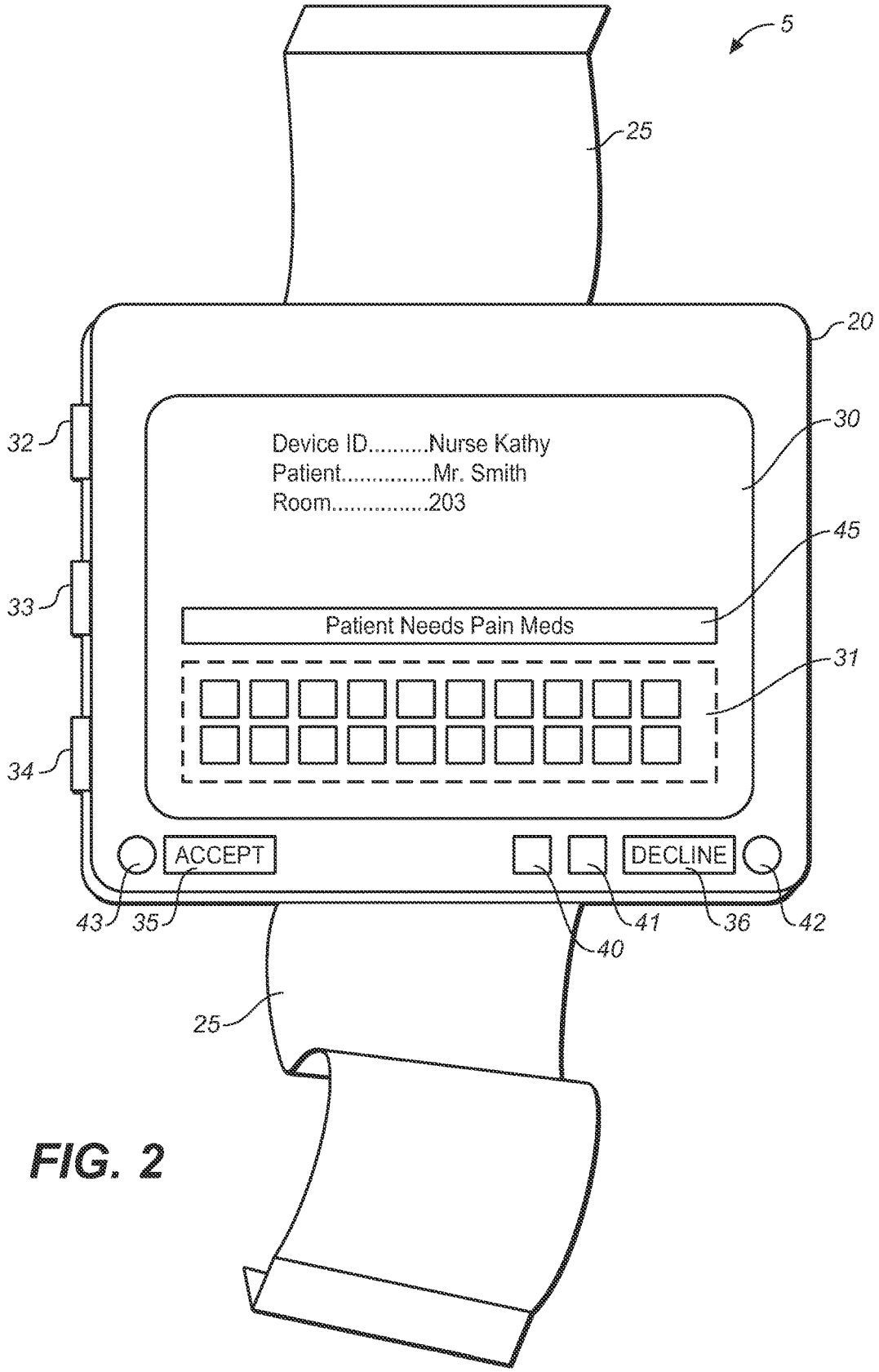
FIG. 2 presents a schematic diagram of the external features of the local display device depicted in FIG. 1A and FIG. 1B
Figure 3:
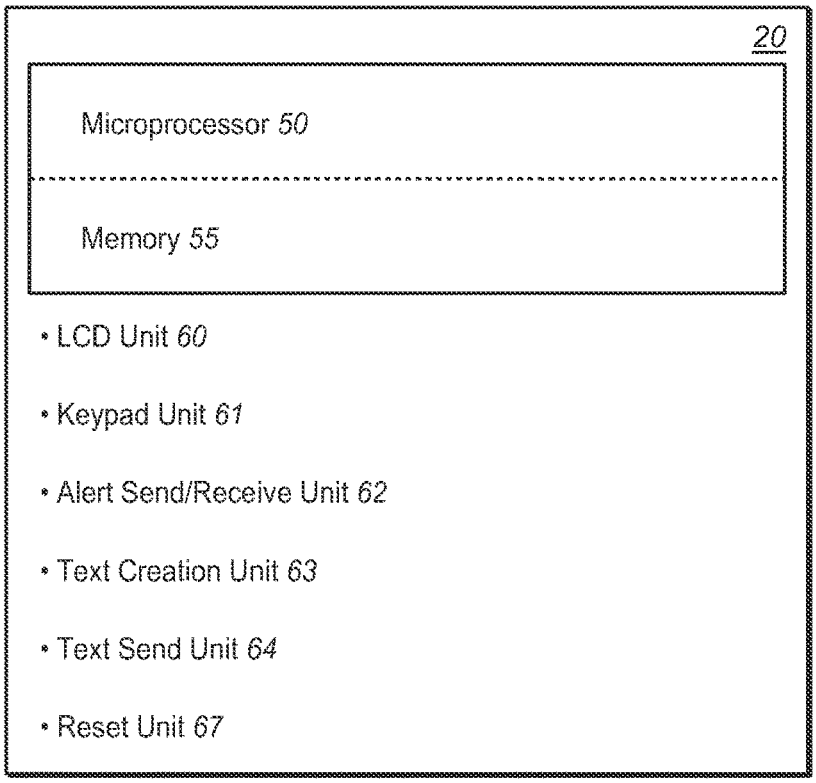
FIG. 3 presents a schematic diagram of the internal features of the local display device depicted in FIG. 1A, FIG. 1B and FIG. 2.

FIG. 2 presents a more detailed illustration of the external features of the local display device 5 and FIG. 3 depicts a block diagram of the internal components of the local display device 5. As noted, the local display device 5 can be worn on the wrist of a healthcare administrator and used by the healthcare administrator to engage in a wireless communicate with a healthcare provider, who is wearing an remote display device 10, concerning any matter primarily related the healthcare of a patient. As shown in FIG. 2, the local display device 5 comprises a housing 20 and a wrist strap 25 attached to the housing 20, with the wrist strap 25 for attaching the local display device 5 to the wrist of the healthcare administrator. The wrist strap 25 can be of any type that is capable of securing the local display device 5 to the wrist. For example, the strap 25 can have two segments that can be releasably attached by means of a hook and loop closure, buckle or clasp, or the strap (not shown) can be a single, expandable segment, such as an elastic band or spring loaded metal band that fits snugly around the wrist. Other means of attaching the local display device 5 to the wrist will be apparent to those skilled in the art. In addition, the local display device 5 can be attached to a chain, similar to a watch fob, and worn around the neck or attached to an item of clothing. The housing 20 also comprises: an LCD display screen 30; an orange level-of-care mechanism 32, illuminated with an orange light emitting diode (LED); a yellow level-of-care mechanism 33, illuminated with a yellow LED; a green level-of-care mechanism 34, illuminated with a green LED; an acknowledgment indicator 35, indicating ACCEPT; an acknowledgment indicator 36, indicating DECLINE; a displayable data entry keypad 31; a create text mechanism 40; a send mechanism 41; a reset mechanism 43; and an ON/OFF mechanism 42. In a preferred embodiment, each of the level-of-care mechanisms can be a depressible button that remains in a down position when depressed and becomes temporarily not operable, and each of the other mechanisms can be depressible buttons that do not stay in a down position when depressed and remain operable, and the acknowledgment indicators 35 and 36 can use LED lights to illuminate the words ACCEPT and DECLINE.

The local display device 5 can be utilized by the healthcare administrator to send level-of-care alerts and text messages to a healthcare provider who is wearing a remote display device 10. Level-of-care alerts are intended to be sent when a non-life threatening condition is brought to the attention of the healthcare administrator by a patient, who typically would contact the healthcare administrator by using a communication device at the patient's bedside. During the conversation between the healthcare administrator and patient, the healthcare administrator can determine the level-of-care needed by the patient and then use local display device 5 to send a level-of-care alert to a remote display device 10 being worn by the patient's healthcare provider: typically a nurse, a patient care technician, or a treating physician. Level-of-care alerts can be sent from a local display device 5 to a remote display device 10 by depressing: 1) the orange level-of-care mechanism 32 requesting immediate attention from the healthcare provider due to an extremely urgent, but not life threatening, level-of-care needed by the patient; 2) the yellow level-of-care mechanism 33 requesting prompt attention from the healthcare provider due to an urgent level-of-care needed by the patient; or 3) the green level-of-care mechanism 34 requesting attention from the healthcare provider as soon as practical due to a non-urgent level-of-care needed by the patient. When one of the level-of-care mechanisms, 32, 34 or 34, is depressed, the displayable data entry keypad 31 is displayed on the LCD display screen 30 and the healthcare administrator is prompted by a message appearing on the LCD display screen 30 above the displayable data entry keypad 31 to use the displayable data entry keypad 31 to enter a unique identification code associated with the remote display device 10 that is being worn by the healthcare provider who is responsible for attending to the needs of the patient and, if necessary, to enter the room number of the patient. And, if the healthcare provider is responsible for attending to the needs of more than one patient, the healthcare administrator can also be prompted by a message appearing on the LCD display screen 30 to identify the name and/or room number of the patient by using the displayable data entry keypad 31 to enter that information. Alternatively, if the local display device operates with a keyboard rather than a keypad, the health care administrator would use the keyboard in lieu of the displayable data entry keypad 31. In order to send the level-of-care alert, the healthcare administrator can depress the send mechanism 41, which causes the local display device 5 to generate a wireless level-of-care signal, corresponding to the selected level-of-care and to send the wireless level-of-care signal, along with any patient identification information, to the remote display device 10 by addressing the level-of-care signal to the remote display device 10 utilizing its unique identification code. Upon receipt of the wireless level-of-care signal, the remote display device 10 displays the level-of-care alert, along with any patient identification information, to a healthcare provider who is wearing the remote display device 10. If the healthcare administrator desires to simultaneously send a level-of-care alert to more than one healthcare provider, the healthcare administrator can enter the unique identification code for each healthcare provider, along with the patient identification information.

In another embodiment, the healthcare administrator can send a text message pertaining to the level-of-care alert that has already been sent to the healthcare provider in order to more specifically describe the patient's needs and/or to communicate any other matter related to the level-of-care alert. To do so, the healthcare administrator can operate the create text mechanism 40 causing a text box 45 to be displayed on the LCD display screen 30. The healthcare administrator can then be prompted by a message appearing in the text box 45 to use the displayable data entry pad 31, or a keyboard if the local display device 5 operates with a keyboard, to enter within text box 45 the text message to be sent to the remote display device 10 that is being worn by the healthcare provider. The healthcare administrator can then send the text message to the healthcare provider by again using the send mechanism 41 to create and send a text signal to the remote display device 10, which causes the text signal to be addressed to the remote display device 10 using the same unique identification code that was used to send the level-of-care alert. When the text signal is received, the remote display device 10 displays the text message to the healthcare provider who is wearing the remote display device 10. If the healthcare administrator has already sent a level-of-care alert to more than one healthcare provider and desires to send a text message to those same providers, the healthcare administrator can also send the text message to those healthcare providers by using the send mechanism 41 to create and send a text signal to the remote display devices 10 being worn by those healthcare providers, which causes the text signal to be addressed to the remote display devices 10 using the same unique identification codes that were used to send the level-of-care alert.

The healthcare provider can respond to a level-of-care alert by using the remote display device 10 to accept or decline the healthcare administrator's request to assist the patient. This action causes the acknowledgment indicator 35 or 36 integral with housing 20 of local display device 5, to display an acknowledgment response by illuminating the word ACCEPT or DECLINE. This feature of local display device 5 is extremely important to the healthcare administrator. If the word ACCEPT is illuminated, the healthcare administrator is assured that the healthcare provider received the level-of-care alert and has committed to respond timely based upon the urgency of the patient's need for assistance as indicated by the level-of-care alert and any other information contained in a text message accompanying the alert. On the other hand, if the word DECLINE is illuminated, the healthcare administrator is instantly informed that the patient's healthcare provider is not able to assist and then can, without undue loss of valuable time, use the local display device 5 to contact another healthcare provider.

If the acknowledgment indicator 35 has illuminated the word ACCEPT, indicating that the healthcare provider has accepted the request to attend to the needs of a patient, the healthcare administrator can press the reset mechanism 43, thereby: 1) returning a depressed mechanism, 32, 33 or 34, to a non-depressed position; 2) turning off the acknowledgment indicator 35; and 3) deleting the display of the patient's name and/or room number and any text message relating to the level-of-care. If the acknowledgment indicator 36 has illuminated the word DECLINE, indicating that the healthcare provider has declined the request to attend to the needs of a patient, the healthcare administrator can press the reset mechanism 43 only once, thereby: 1) returning a depressed mechanism, 32, 33 or 34, to a non-depressed position; 2) turning off the acknowledgment indicator 36; and 3) preserving the display of the patient identification information and any text message. Preserving the patient information and any text message allows the healthcare administrator to avoid having to take time to retype the information if the same level-of-care alert is going to be sent to another healthcare provider. And, the ON/OFF mechanism 42 can be used to activate or deactivate the supply of battery power to local display device 5. In the event that the healthcare administrator sends a level-of-care alert to more than one of healthcare providers as discussed above, the acknowledgment indicators 35 or 36 within local display device 5 will only illuminate the word ACCEPT or DECLINE in response to the first acknowledgment response signal received from a healthcare provider.

Referring again to FIG. 3, the figure illustrates the internal components of housing 20 within local display device 5 that are used to implement the functions of local display device 5 and the communications between the local display device 5 and remote display device 10 described above. Specifically, those internal components comprise a microprocessor 50 and memory 55, with an LCD unit 60, a keypad unit 61 and an alert send/receive unit 62, a text creation unit 63, a text send unit 64, and a reset unit 67 all stored in the memory 55 that is accessible to the microprocessor 50. As used herein the word "unit" refers to either software or firmware as dictated by the specific device architecture. When battery power is supplied to the microprocessor 50 utilizing the ON/OF mechanism 42, the microprocessor 50 uses the LCD unit 60 to activate the LCD display screen 30 and the keypad unit 61 to activate the displayable data entry pad 31, and activates all of the other internal components. As previously noted, the healthcare administrator can initiate the communication of a level-of-care alert to a healthcare provider by depressing the orange level-of-care mechanism 32, yellow level-of-care mechanism 33 or green level-of-care mechanism 34. This action causes the keypad unit 61 to display the displayable data entry pad 31 on the LCD display screen 30 and the alert send/receive unit 62 to display a text message on the LCD display screen 30, prompting the healthcare administrator to use the displayable data entry pad 31 to enter the unique identification code of the healthcare provider to whom the alert is to be sent and, if necessary, to identify the patient and/or the patient's room number. When the healthcare administrator depresses the send mechanism 41, the alert send/receive unit compares the unique identification code that has been typed to a list of unique identification codes stored in memory 55. If there is a match, the alert send/receive unit 62 generates a wireless level-of-care signal and sends the wireless level-of-care signal, along with any patient identification information, to the remote display device 10 by addressing the signal to the remote display device 10 using its unique identification code. If there is no match, the alert send/receive unit 62 displays a message on LCD display screen 30 that the room number is not valid and prompts the healthcare administrator to re-enter the room number. The alert send/receive unit 62 can also receive an wireless acknowledgment signal from remote display device 10 indicating whether the healthcare provider accepts or declines the level-of-care request and illuminates either the word ACCEPT or word DECLINE as appropriate.

As noted, the healthcare administrator can also send a text communication pertaining to a level-of-care alert to a healthcare provider by depressing the create text mechanism 40. This action causes the text creation unit 63 to display the text box 45 on the LCD display screen 30 for use by the healthcare administrator in typing a text message in the text box 45 using the displayable data entry pad 31. The healthcare administrator can then depress the send mechanism 41, causing the text send unit 64 to create and to send a text signal to the remote display device 10 worn by the patient's healthcare provider by addressing the text signal to the remote display device 10 using the same unique identification code that was used to send the level-of-care alert. Upon receipt of the text message signal, the message is displayed to a healthcare provider wearing the remote display device 10. And, the reset unit 67 is provided to enable the healthcare administrator to use the reset mechanism 43 to return a depressed level-of-care mechanism, 32, 33 or 34, to a non-depressed condition, to turn off the ACCEPT or DECLINE lights, and to delete or preserve any patient identification information and any text message relating to a level-of-care alert.

Figure 5:
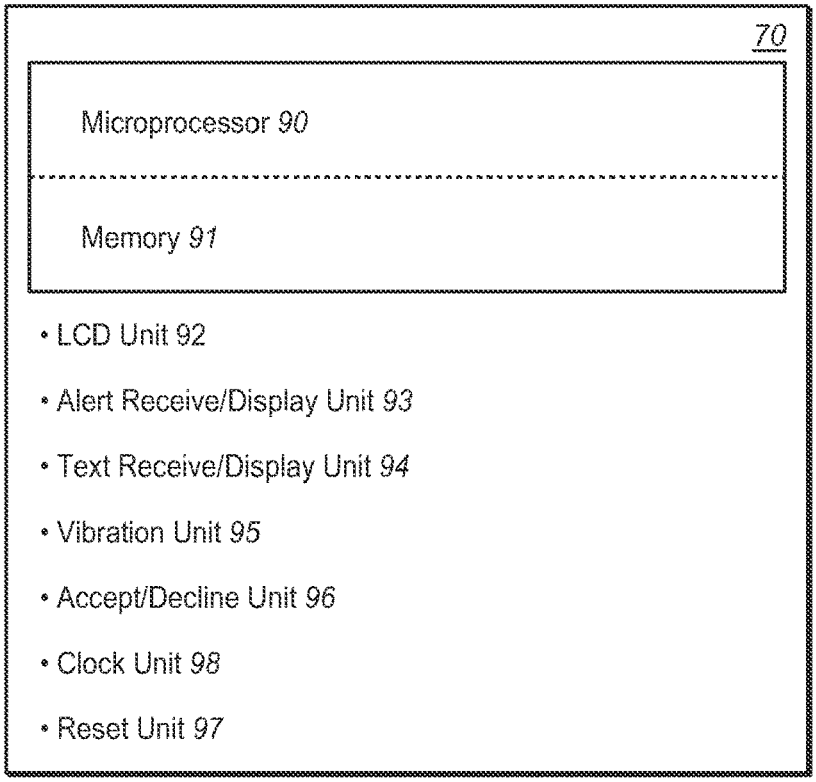
FIG. 5 presents a schematic diagram of the internal features of the remote display device depicted in FIG. 1A, FIG. 1B and FIG. 4.
Figure 4:
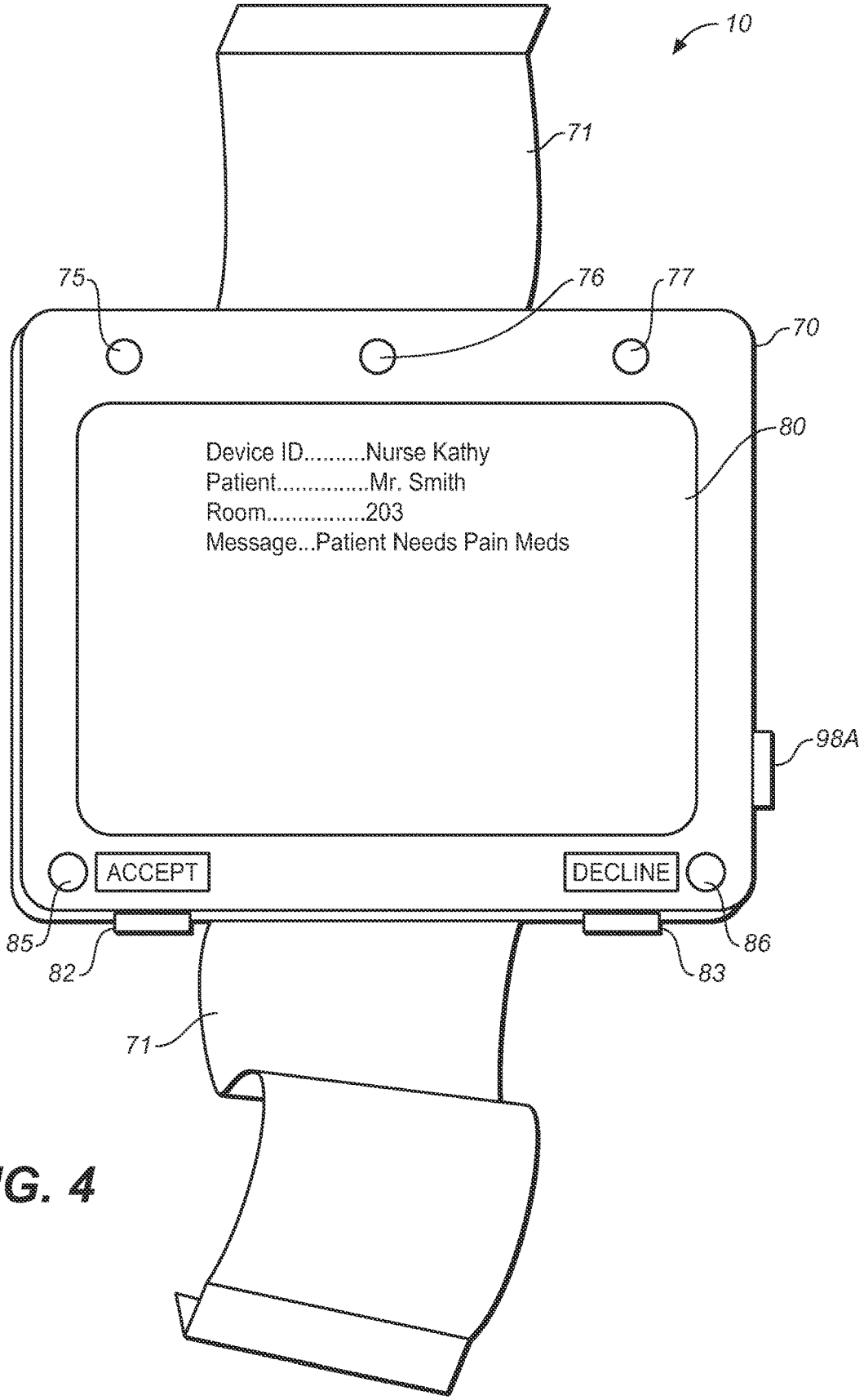
FIG. 4 presents a schematic diagram of the external features of the remote display device depicted in FIG. 1A and FIG. 1B

FIG. 4 presents a more detailed illustration of the external features of the remote display device 10, and FIG. 5 depicts a block diagram of the internal components of the remote display device 10. As previously noted, the remote display device 10 can be worn on the wrist of a healthcare provider and used by the healthcare provider to communicate with the healthcare administrator, who is wearing a local display device 5, concerning any matter primarily related the healthcare of a patient. As shown in FIG. 4, the remote display device 10 comprises a housing 70 and a wrist strap 71 attached to the housing 70, with the wrist strap 71 for securing the remote display device 10 to the wrist of the healthcare provider. The wrist strap 71, just like the wrist strap 25 for local display device 5, can be of any type that is capable of securing the remote display device 10 to the wrist. For example, the strap 25 can have two segments that can be releasably attached by means of a hook and loop closure, buckle or clasp, or the strap (not shown) can be a single, expandable segment, such as an elastic band or spring loaded metal band that fits snugly around the wrist. Similarly, the remote device 10 can be attached to a chain, similar to a watch fob, and worn around the neck or attached to an item of clothing. The housing 70 further comprises: 1) an orange level-of-care indicator 75, illuminated with an orange LED; yellow level-of-care indicator 76, illuminated with a yellow LED; and a green level-of-care indicator 77, illuminated with a green LED, with each of the level-of-care indicators for alerting the healthcare provider that that the healthcare administrator has sent a level-of-care alert to the healthcare provider; 2) an LCD display screen 80 for displaying a text message to the healthcare provider that has been sent by the healthcare administrator; 3) an acknowledgment mechanism 82 that can be depressed by the healthcare provider in order to accept to respond to a level-of-care alert, and an acknowledgment mechanism 83 that can be depressed by the healthcare provider in order to decline to respond to a level-of-care alert; 4) a reset mechanism 85 for turning off a level-of-care indicator and for returning the acknowledgment mechanism 82 or 83 to an non-depressed position; and 5) an ON/OFF mechanism 86 for activating and deactivating the remote display device 10. And, in another embodiment (no shown) housing 70 within remote display device 10 can include a data entry device for use by a healthcare provider in sending a text message to the healthcare administrator.

The remote display device 10 can be operated by a healthcare provider to receive level-of-care alerts and text messages from a healthcare administrator, who is operating a local display device 5, and to respond to the level-of-care alerts and text messages. In order to alert a healthcare provider wearing the remote display device 10 that a level-of-care alert has been sent by the healthcare administrator, the remote display device 10, as appropriate, illuminates: the orange level-of-care indicator 75, indicating the need for immediate attention from the healthcare provider due to an extremely urgent level-of-care requested by the healthcare administrator; the yellow level-of-care indicator 76, indicating the need for immediate attention from the healthcare provider due to an urgent level-of-care requested by the healthcare administrator; the level-of-care indicator 76, indicating the need for attention as soon as practical from the healthcare provider due to a non-urgent level-of-care requested by the healthcare administrator. A text message is received by displaying the message on the LCD display screen 80, and the acknowledgment mechanism 82 or 83 can be used by the healthcare provider to correspondingly accept or decline the level-of-care request.

Now referring to FIG. 5, the figure illustrates the internal components of the housing 70 within remote display device 10 that are used to implement the functions of the remote display device 10 and the communication between the local display device 5 and the remote display device 10 set forth above. The housing 70 contains a microprocessor 90 and associated memory 91, with battery power being supplied to the microprocessor when the ON/OFF mechanism 86 is depressed by the healthcare provider. As soon as power is supplied to the microprocessor 90, it activates the following components all stored in memory 91: an LCD unit 92, an alert receive/display unit 93, a text receive/display unit 94, a vibration unit 95, an accept/decline unit 96, a clock unit 98 and a reset unit 97. The alert receive/display unit 93 is used to receive the wireless level-of-care signal sent from the alert send/receive unit 62 within the local display device 5 and causes the: green level-of-care indicator 75, the yellow level-of-care indicator 76 or the orange level-of-care indicator 77 to illuminate, depending on whether the wireless level-of-care signal is associated with a green, yellow or orange level-of-care alert. The text receive/display unit 94 is utilized to receive the text message signal coming from the text send unit 64 within the local display device 5 and to cause the text message to be displayed on the LCD display screen 80. The vibration unit 95 can be utilized to cause the remote display device's housing 70 to vibrate when a wireless level-of-care signal is received by the alert receive/display unit 93, with the vibration creating a tactile sensation on the wrist of the healthcare provider. The visual alert light and tactile sensation are utilized to ensure that the healthcare provider becomes instantly aware of a request for providing assistance to a patient, without creating any significant interruption to the care the provider may be providing to different patient.

When the healthcare provider becomes aware that one of the level-of-care lights has been illuminated, the healthcare provider can depress the acknowledgment mechanism 82 or the acknowledgment mechanism 83 in order to correspondingly accept or decline the indicated request for attending to the needs of a patient. Activation of either mechanism 82 or 83 will cause the accept/decline unit 96 to send an accept or a decline wireless acknowledgment signal to the alert send/receive unit 62 within the housing 20 of the local display device 5. In this regard, the accept/decline unit 96 is programmed to always address an accept or a decline wireless acknowledgment signal to the local display device 5 worn by the healthcare administrator. Once the accept or decline wireless acknowledgment signal is received, the alert send/receive unit 62 causes the acknowledgment indicator 35 or 36 within housing 20 of the local display device 5 to correspondingly illuminate the word ACCEPT or DECLINE. Activating the acknowledgment indicator 82 or 83 will also send a signal to the vibration unit 95 that will turn off the vibration. Pressing the reset mechanism 85 causes the reset unit 97 to turn off any of the level-of-care alert lights that have been illuminated and to return acknowledgment mechanism 82 or 83 that has been depressed to a non-depressed position.

In yet another embodiment, remote display device 10 can include the feature of timing the amount of time it takes for a healthcare provider to respond to a level-of-care alert from the healthcare administrator. This feature can be implemented by the clock unit 98, within housing 70 of remote display device 10, that is activated when a level-of-care alert is received by alert receive/display unit 93 and deactivated when the healthcare provider depresses the acknowledgment mechanism 82 or 83, accepting or declining the healthcare administrators request for attending to the needs of a patient. The elapsed time data can be stored in memory 91 and associated with the unique identification code assigned to the remote display device 10 being worn by the healthcare provider. The elapsed time data can then be downloaded to a USB storage device through USB port 98A provided on housing 70. Alternatively, the elapsed time data can be downloaded directly to a computer. The elapsed time data can be a valuable administrative tool for use in evaluating the responsiveness of healthcare providers to level-of-care alerts.

The present portable alert communication system described herein solves a long-standing problem with current healthcare communication systems that rely on voice communications within a healthcare facility. Healthcare systems currently utilize telephone-type systems to establish voice communication between a healthcare administrator and a healthcare provider concerning the healthcare needs of a patient. In these systems, a healthcare administrator uses a stationary telephonic device to establish voice communication with a healthcare provider, carrying a mobile telephonic device, by dialing the provider's phone number, which causes the healthcare providers phone to ring. If the healthcare provider answers the call, the two parties can discuss the healthcare needs of one of the provider's patient and determine if the healthcare provider can timely respond to the patient's needs. In many instances, however, the healthcare administrator's call occurs while the healthcare provider is currently attending to the needs of a patient. This circumstance creates a serious dilemma for the healthcare provider. Should the healthcare provider simply ignore the call and continue attending to the needs of the current patient or should the provider stop providing care and engage in a conversation with the healthcare administrator to find out what are the needs of the other patient. By ignoring the call, the healthcare provider is putting the healthcare needs of the current patient above the needs of the other patient, without knowing what the other patient's healthcare needs are. And, by answering the call, the healthcare provider is, at least temporarily, giving the other patient's health care needs priority over the current patient, again without knowing what the other patient's healthcare needs are. Further, the decision to answer the call could potentially cause a serious disruption in the intimate relationship between patient and caregiver due to the appearance, real or not, that the current patient is not as important to the healthcare provider as another patient. Since it is well known that an intimate relationship between patient and caregiver can provide the patient with, at least, a therapeutic sense of wellbeing and may even contribute to a more favorable outcome for the patient, any disruption in that relationship can be deleterious for the patient. On the other hand, the decision not to answer the call potentially jeopardizes the healthcare needs of the other patent. In that circumstance, the healthcare administrator must decide whether to take the time to try calling the healthcare provider back, hoping that the call will be answered. If the call is ultimately not answered, the healthcare administrator would then start calling other healthcare providers until one of them answered the call, with each call increasing the delay in providing the other patient with potentially urgently needed assistance. Another limitation of existing healthcare communication systems is that the system administrators operate stationary communication stations in order to contact the healthcare providers. This feature constrains the system administrators to their station. As a result, if the administrator needs to leave the station temporarily, ideally he or she must make sure that someone else, who is competent to respond to patients' needs for assistance, is able to perform that function. If no one else is available, the administrator may have to leave the station uncovered and the potential needs of patients unmet. Additional limitations in existing systems relate to "alarm fatigue" and isolation rooms discussed in the Background Section above.

These limitations in current healthcare communication systems are all overcome by the present portable alert communication system, in part, because the visual level-of-care alerts and text messages that are displayed on the remote display device 10 worn by a healthcare provider present the healthcare provider with silent communications that are sufficient for the healthcare provider to make an informed decision as to whether he or she can timely respond to the needs of the patient. Since the level-of-care alerts and text messages are received as silent displays by the remote display device 10, any potential distress that a patient might experience due to a voice communication is illuminated. The silent level-of-care communication can also be coupled with the feature that causes the remote display device 10 to vibrate when a wireless level-of-care signal is received, giving the healthcare provider a tactile sensation that an alert has been received, again without potentially disrupting the patient's sense of well-being. The remote display device 10 also provides a feature that allows the healthcare provider to instantly and silently communicate to the healthcare administrator that the healthcare provider either accepts or declines the request to assist the patient by simply depressing the acknowledgment mechanism 82 or 83, respectively.

In addition, the present alert communication system overcomes the problem of stationary telephonic devices operated by healthcare administrators. Since the local display device 5 can be worn on the wrist of the healthcare administrator, the healthcare administrator is always in communication with the patients. Thus, there is never any need to find someone to cover the administrator's station. The alert communication system also reduces the potential for alarm fatigue since the level of care alerts are sent to healthcare providers silently. The present system has another important benefit in that the remote display device 10 can also provide for the ability to measure the amount of time it takes the healthcare provider to respond to a level-of-care alert. The timing data that is collected can then be used administratively to evaluate the healthcare provider's work performance and provide an incentive to promptly respond to level-of-care alerts.

With respect to alarm fatigue, the present portable alert communication system makes a substantial contribution to reducing the possibility that a healthcare provider may become distracted by all of the sounds that can be emitted in a patient's room. It does so by removing the ringing telephonic devices that are carried by healthcare providers and replaces the ringing devices with the local display device worn by the healthcare providers that can be used by them to silently receive a request for patient assistance from the healthcare administrator and to silently send a response indicating the ability or not to fulfill the request. And, regarding the healthcare provider's practical inability to respond to a ringing phone while he or she is wearing a sterilized gown in an isolation room, the present portable alert communication system provides the ability for the healthcare provider to receive an alert visually. This feature is provided due to the fact that the alert indicator colors, emitted by the local display device worn on the healthcare provider's wrist, are visible through the gown. In addition, since the local display device can vibrate simultaneously with the emitted colored lights, the healthcare provider can be prompted by a tactile sensation to look at the local display device.

Figure 6:
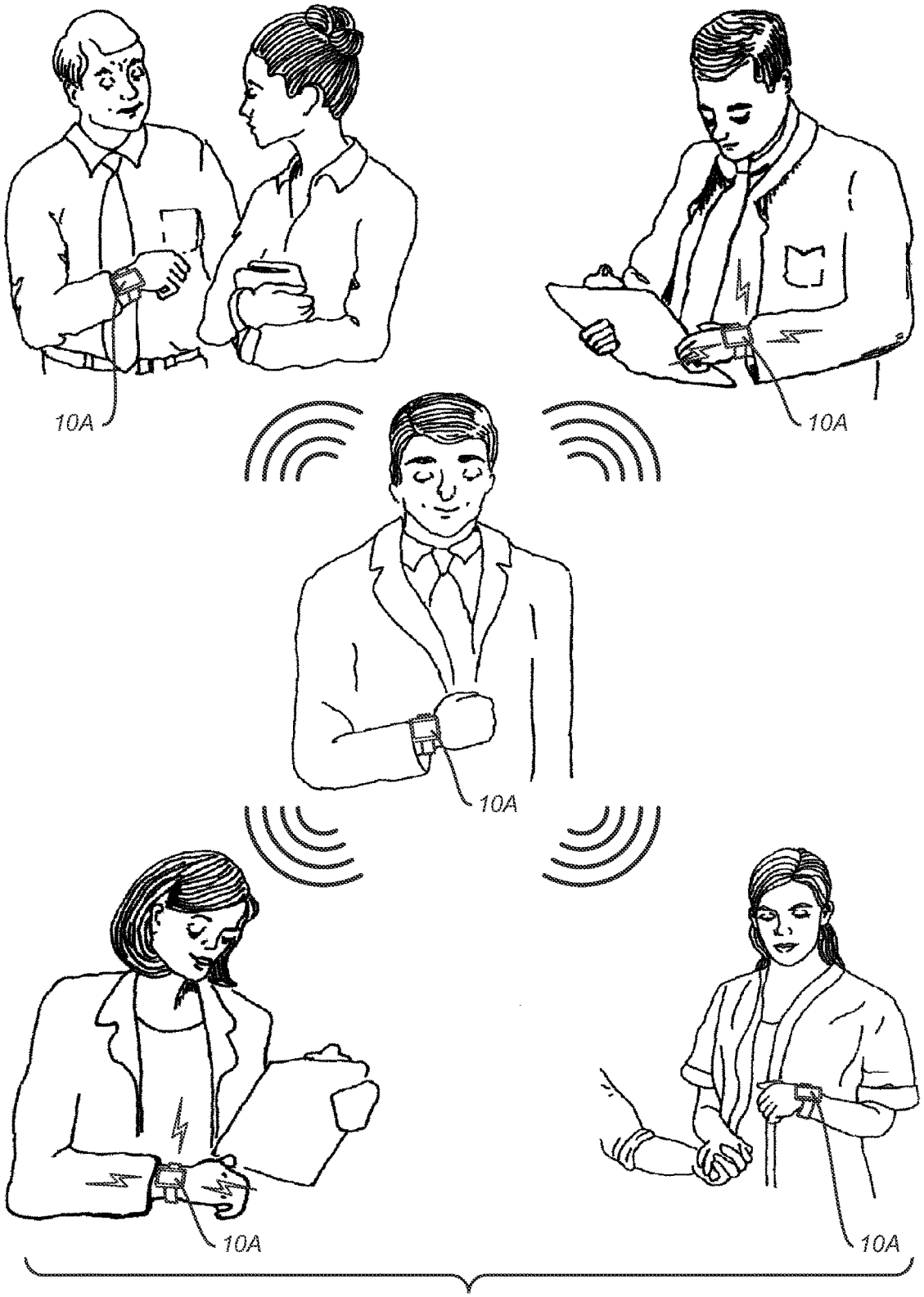
FIG. 6 presents a pictorial representation of a healthcare provider, who is wearing a remote display device that can be being used to wirelessly communicate with a plurality of other remote display devices worn by a corresponding plurality of healthcare providers.
Figure 7:
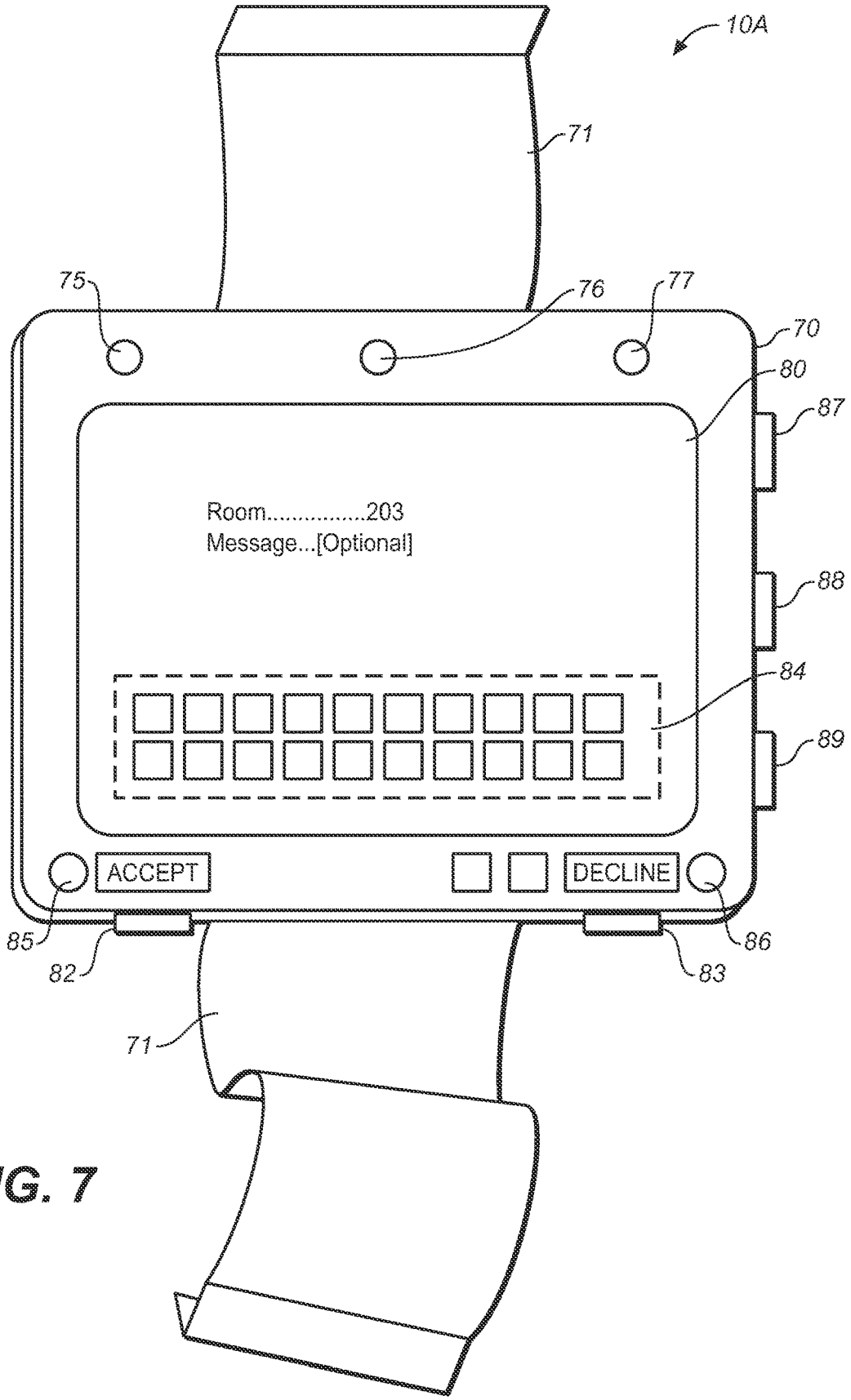
FIG. 7 presents a schematic diagram of the external features of the remote display device depicted in FIG. 6.

FIG. 6 pictorially illustrates another embodiment of the portable alert communication system in which a healthcare provider wearing a remote display device 10A can use the remote display device to communicate an emergency alert to a plurality of healthcare providers, who are similarly wearing a remote display device 10A. In this embodiment and as further illustrated in FIG. 7, the remote display device 10A has the same external components as remote display device 10, but remote display device 10A also comprises: a code blue mechanism 87, illuminated with a blue LED; a code purple mechanism 88, illuminated with a purple LED; a code red mechanism 89, illuminated with a red LED; and a displayable data entry pad 84 that can be displayed on LCD display screen 80. The code blue mechanism 87 can be depressed by a healthcare provider in order to instantly and silently send an emergency alert, requesting the immediate assistance from the plurality of healthcare providers, each of whom are wearing a remote display device 10A, in attending to the needs of a patient who is experiencing a presently existing life threatening, emergency condition, usually caused by respiratory or cardiac arrest. As soon as the code blue mechanism 87 is depressed, the remote display device 10A displays the displayable data entry pad 84 and, above the data entry pad, displays the word "ROOM", prompting the healthcare provider to enter the patient's room number using the displayable data entry pad 84. Then the remote display device 10A sends an emergency code signal that corresponds to the selected code and sends the room number, to each remote display device 10A (utilizing its unique identification code) worn by a corresponding healthcare provider out of the plurality of healthcare providers. Upon receipt of the emergency code signal, each remote display device 10A instantly and silently displays on its LCD display screen 80 a code blue emergency alert to the healthcare provider who is wearing the remote display device 10A. Preferably, the display of the code blue emergency alert is accomplished by causing a peripheral area of the LCD display screen 80 to intermittently flash a bright blue color, using a plurality of blue LEDs, and by causing the room number to be constantly displayed in large letters in the center of the display. The code blue emergency alert will continue to flash and the room number will continue to be displayed until the healthcare provider depresses the reset alert mechanism 85 or are automatically turned off after a predetermined time. In another embodiment, when the code blue alert mechanism 87 is depressed, the plurality of remote display devices 10A will vibrate simultaneously with the code blue flash and room number displays, and will continue to vibrate until the reset alert mechanism 85 is depressed or will terminate after a predetermined time.

The code purple mechanism 88 can be depressed by a healthcare provider in order to instantly and silently request the immediate assistance from the plurality of healthcare providers, each of whom are wearing a remote display device 10A, in attending to the needs of a patient who is experiencing a potentially life threatening, emergency condition. As soon as the code purple mechanism 88 is depressed, the remote display device 10A displays the displayable data entry pad 84 and, above the pad, displays the word "ROOM", prompting the healthcare provider to enter the patient's room number using the displayable data entry pad 84. Then the remote display device 10A sends an emergency code signal that corresponds to the selected code and sends the room number, to each remote display device 10A (utilizing its unique identification code) worn by a corresponding healthcare provider out of the plurality of healthcare providers. Upon receipt of the emergency code signal, each remote display device 10A instantly and silently displays on its LCD display screen 80 a code purple emergency alert to the healthcare provider who is wearing the remote display device 10A. Preferably, the display of the code purple emergency alert is accomplished by causing a peripheral area of the LCD display screen 80 to intermittently flash a bright purple color, using a plurality of purple LEDs, and by causing the room number to be constantly displayed in large letters in the center of the display. The code purple emergency alert will continue to flash and the room number will continue to be displayed until the healthcare provider depresses the reset alert mechanism 85 or are automatically turned off after a predetermined time. In another embodiment, when the code purple alert mechanism 88 is depressed, the plurality of remote display devices 10A will vibrate simultaneously with the code purple flash and room number displays, and will continue to vibrate until the reset alert mechanism 85 is depressed or will terminate after a predetermined time. In yet another embodiment, a code purple emergency alert can include a text message that accompanies the alert. Since a code purple emergency relates to a potential life threatening condition, rather than a presently existing life threatening condition as in a code blue emergency, the healthcare practitioner requesting assistance has the option to determine that there is time to also send a text message to the plurality of healthcare providers that briefly describes the nature of the potentially life threatening condition. If so, the healthcare practitioner also can be prompted by message on the LCD display screen 80 to briefly describe the nature of the code purple emergency alert. The ability to describe the nature of the code purple emergency in the text message can have the effect of only obtaining the assistance from those healthcare providers who are most able to attend to the patient's needs.

The code red mechanism 89 is intended to be used for all emergencies that are not code blue or code purple emergencies. The code red mechanism 89 can be depressed by a healthcare provider in order to instantly and silently advise the plurality of healthcare providers, each of whom are wearing an remote display device 10A as shown in FIG. 6, that an emergency exists within the healthcare facility. As soon as the code red mechanism 89 is depressed, the remote display device 10A displays the word "EMERGENCY" (rather than the word "ROOM" as in a code blue or purple) prompting the healthcare provider to optionally describe the emergency using the displayable data entry pad 84 and, if relevant, input the location. Some emergencies, for example, might include: a bomb threat requiring evacuation; a violent person or patient; a hostage situation; a patient abduction; psychiatric situation; lost or disorderly elderly patient; or an overloaded emergency department. Then the remote display device 10A sends an emergency code signal that corresponds to the selected code and sends the room number, to each remote display device 10A (utilizing its unique identification code) worn by a corresponding healthcare provider out of the plurality of healthcare providers. Upon receipt of the emergency code signal, each remote display device 10A instantly and silently displays on its LCD display screen 80 a code red emergency alert to the healthcare provider who is wearing the remote display device 10A. Preferably, the display of the code red emergency alert is accomplished by causing a peripheral area of the LCD display screen 80 to intermittently flash a bright red color, using a plurality of purple LEDs, and by causing the room number to be constantly displayed in large letters in the center of the display. The code red emergency alert will continue to flash and the room number will continue to be displayed until the healthcare provider depresses the reset mechanism 85 or are automatically turned off after a predetermined time. In another embodiment, when the code red mechanism 87 is depressed, the plurality of remote display devices 10A will vibrate simultaneously with the code red flash and room number displays, and will continue to vibrate until the reset mechanism 85 is depressed or will terminate after a predetermined time.

Figure 8:
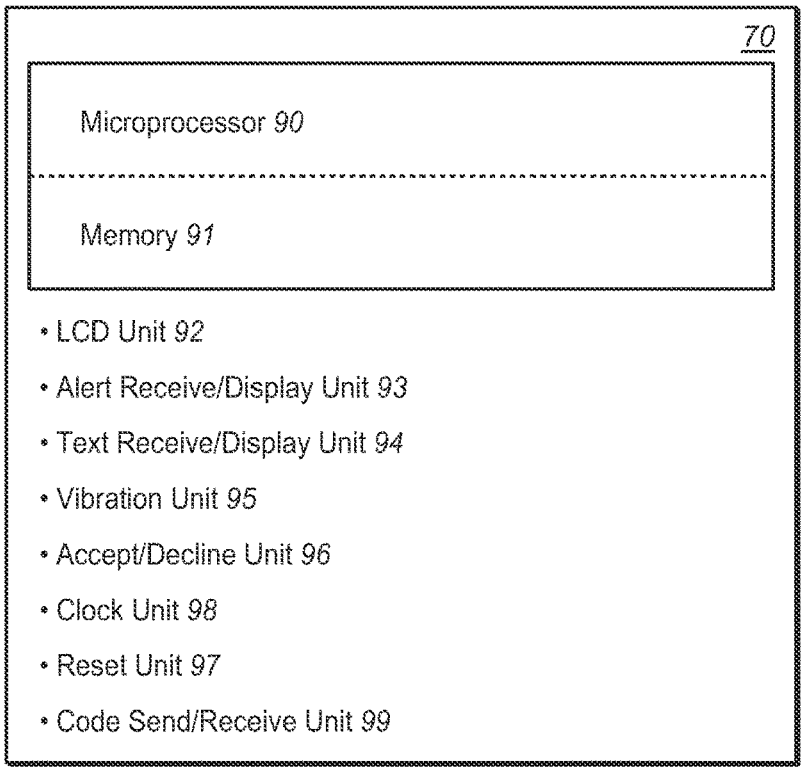
FIG. 8 presents a schematic diagram of the internal features of the remote display device depicted in FIG. 6 and FIG. 7

FIG. 8 illustrates the internal components of remote display device 10A that relate to the operation of the code blue mechanism 87, code purple mechanism 88 and code red mechanism 89. In this regard and as further illustrated in FIG. 8, the remote display device 10A has the same internal components as remote display device 10, but remote display device 10A also comprises a code send/receive unit 99, and a reset unit 97 with additional functionality. The code send/receive unit 99 within housing 70 of remote display device 10A is stored in memory 91 and activated by the microprocessor 90 to send code blue, purple and red emergency alerts to the plurality of remote display devices 10A being worn by a corresponding plurality of healthcare providers. When a code blue or a code purple emergency alert is initiated by a healthcare provider by depressing a code blue or code purple mechanism, 87 or 88, the code send/receive unit 99: 1) causes LCD display screen 80 to prompt the healthcare provider to use the data entry device 84 to enter the patient's room number; 2) generates an emergency code signal that is associated with the selected code, the room number and, for a code purple alert, any additional information relevant to selected code; and 3) sends the emergency code signal to the plurality of healthcare providers by addressing the emergency code signal to each remote display device 10A within the plurality of remote display devices 10A. If a code red emergency alert is initiated, the code send/receive unit 99: 1) uses LCD display screen 80 to prompt the healthcare provider to use the data entry device 84 to describe the nature of the emergency and, if relevant, it's location; 2) generates an emergency code signal that is associated with the selected code and its description; and 3) sends the emergency code signal to the plurality of healthcare providers by addressing the code signal to each remote display device 10A within the plurality of remote display devices 10A. The code send/receive unit 99 addresses the plurality of remote display devices 10A by obtaining from the memory 91 a plurality of identification codes associated with a corresponding plurality of remote display devices 10A. The emergency code signal sent by code send/receive unit 99 is received by a code send/receive unit 99 within each of the plurality of remote display devices 10A and is used to display the appropriate emergency alert and other information on the LCD display screen 80 of each remote display device 10A. And, the reset unit 97 has the additional function of returning a depressed code alert mechanism, 87, 88, or 89, to its non-depressed position.

Figure 9:
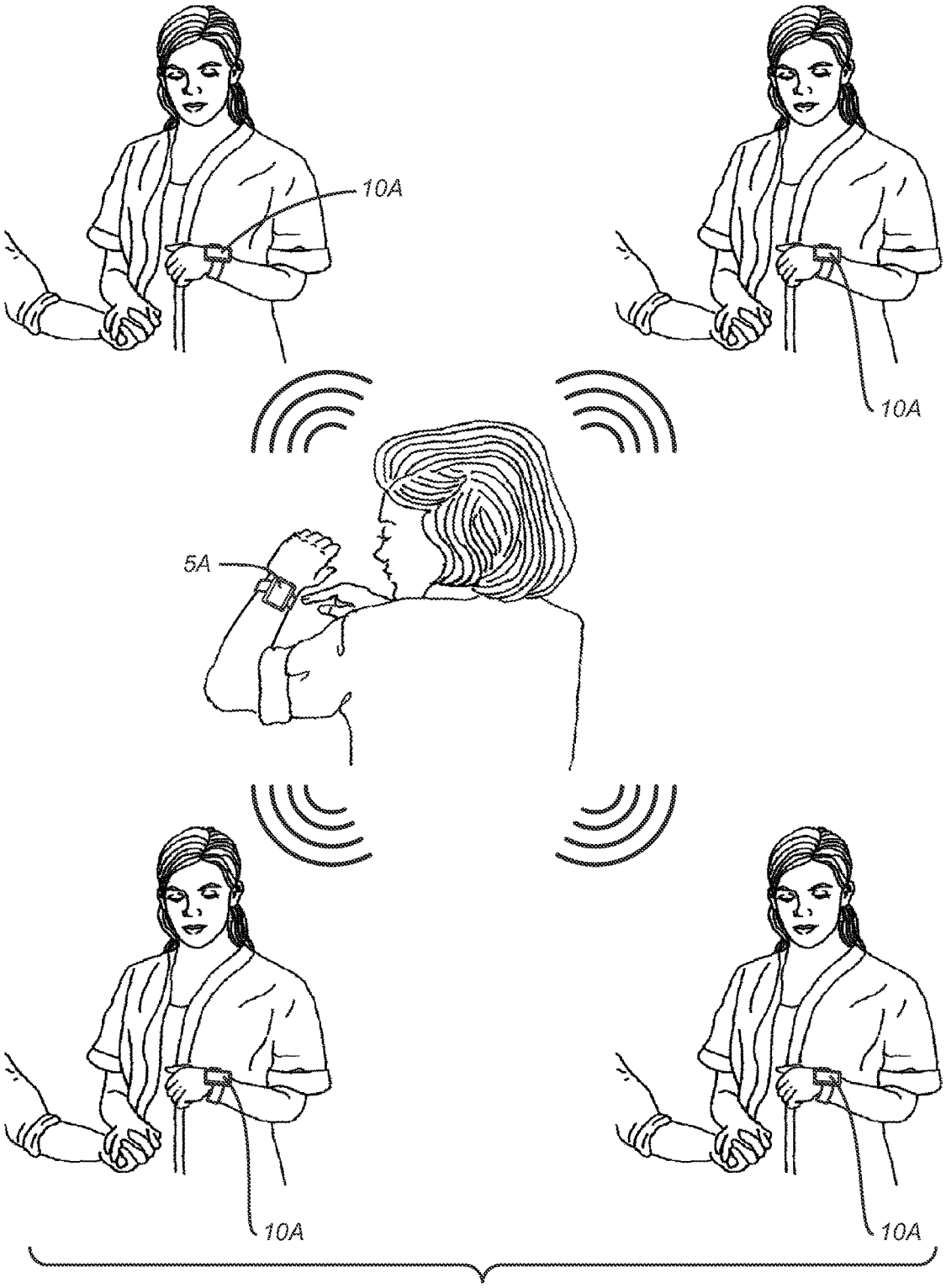
FIG. 9 presents a pictorial representation of a healthcare administrator, who is wearing a local display device that can be being used to wirelessly communicate with a plurality of a remote display devices worn by a corresponding plurality of healthcare providers.
Figure 10:
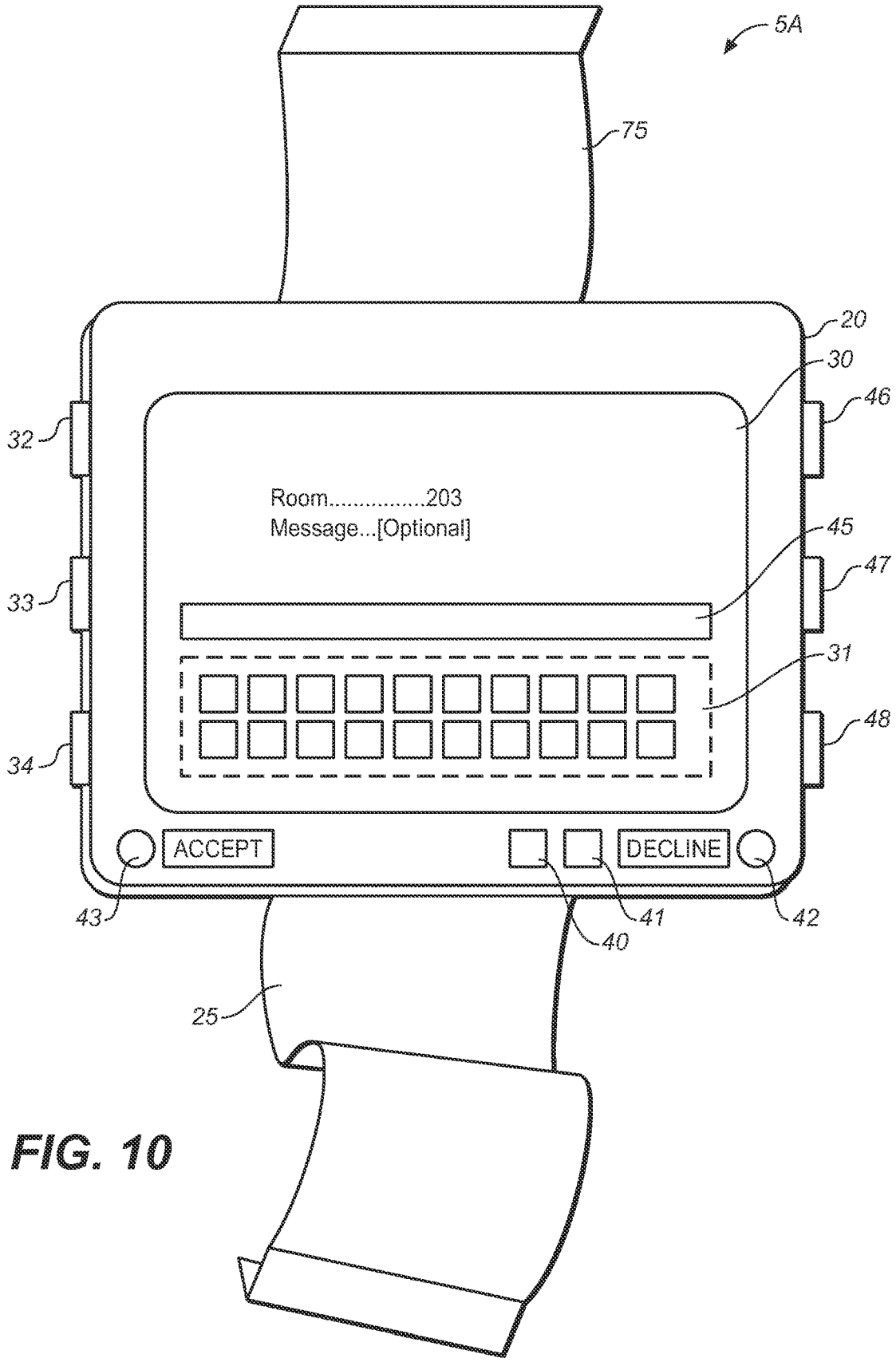
FIG. 10 presents a schematic diagram of the external features of the local display device depicted in FIG. 9.

FIG. 9 illustrates another embodiment of the portable alert communication system, in which the healthcare administrator can initiate an emergency alert, just like a healthcare provider. In this embodiment, the healthcare administrator can use local display device 5A, which as illustrated in FIG. 10 has the same external components as local display device 5, but also comprises a code blue mechanism 46, illuminated with a blue LED; a code purple mechanism 47, illuminated with a purple LED; and a code red mechanism 48, illuminated with a red LED. The code blue mechanism 46 can be depressed by the healthcare administrator in order to instantly and silently advise the plurality of healthcare providers, each of whom is wearing an remote display device 10A, that a patient requires immediate attention due to a presently existing life threatening, emergency condition, usually caused by respiratory or cardiac arrest. As soon as the code blue mechanism 46 is depressed, the local display device 5A displays the word "ROOM", prompting the healthcare administrator to enter the patient's room number using the displayable data entry pad 31. Then the local display device 5A sends an emergency code signal that corresponds to the selected code and sends the room number to each remote display device 10A (utilizing its unique identification code) worn by a corresponding healthcare provider out of the plurality of healthcare providers. Upon receipt of the emergency code signal, each remote display device 10A instantly and silently displays on its LCD display screen 80 a code blue emergency alert to the healthcare provider who is wearing the remote display device 10A. Preferably, the display of the code blue emergency alert is accomplished by causing a peripheral area of the LCD display screen 80 to intermittently flash a bright blue color, using a plurality of blue LEDs, and by causing the room number to be constantly displayed in large letters in the center of the display. The code blue emergency alert will continue to flash and the room number will continue to be displayed until the healthcare provider depresses the reset alert mechanism 85 or are automatically turned off after a predetermined time. In another embodiment, when the code blue mechanism 46 is depressed, the plurality of remote display devices 10A will vibrate simultaneously with the code blue flash and room number display, and will continue to vibrate until the reset alert mechanism 85 is depressed or will terminate after a predetermined time.

The code purple alert mechanism 47 can be depressed by a healthcare administrator in order to instantly and silently request rapid assistance from the plurality of healthcare providers, each of whom is wearing a remote display device 10A, in attending to the needs of a patient who is experiencing a potentially life threatening condition. When the code purple alert mechanism 47 is depressed, the local display device 5A displays the word "ROOM", prompting the healthcare provider to enter the patient's room number using the displayable data entry pad 31. Then the local display device 5A sends an emergency code signal that corresponds to the selected code and sends the room number to each remote display device 10A (utilizing its unique identification code) worn a corresponding healthcare provider out of the plurality of healthcare providers. Upon receipt of the emergency code signal by each of the remote display devices 10A out of the plurality of remote display devices, each remote display device 10A instantly and silently displays on its LCD display screen 80 a code purple emergency alert to the healthcare provider who is wearing the remote display device 10A. Preferably, the display of the code purple emergency alert is accomplished by causing a peripheral area of the LCD display screen 80 to intermittently flash a bright purple color, using a plurality of red LEDs, and by causing the room number to be constantly displayed in large letters in the center of the display. The code purple will continue to flash and the room number will continue to be displayed until the healthcare provider depresses the reset alert mechanism 85 or is automatically turned off after a predetermined time. In another embodiment, when the code purple alert mechanism 88 is depressed, the plurality of remote display devices 10A will vibrate simultaneously with the code purple flash and room number display, and will continue to vibrate until the reset alert mechanism 85 is depressed or will terminate after a predetermined time. In yet another embodiment, a code purple emergency alert can include a text message that accompanies the alert. Since a code purple emergency relates to a potential life threatening condition, rather than a presently existing life threatening condition as in a code blue emergency, the healthcare administrator requesting assistance has the option to determine that there is time to also send a text message to the plurality of healthcare providers that briefly describes the nature of the potentially life threatening condition. If so, the healthcare administrator also can be prompted by a message on the LCD display screen to briefly describe the nature of the code purple emergency alert. The ability to describe the nature of the code purple emergency in the text message can have the effect of only obtaining the assistance from those healthcare providers who are most able to attend to the patient's needs.

The code red alert mechanism 48 is intended to be used for all emergencies that are not code blue or code purple emergencies. The code red mechanism 48 can be depressed by a healthcare administrator in order to instantly and silently advise the plurality of healthcare providers, each of whom are wearing an remote display device 10A as shown in FIG. 6, that an emergency exists within the healthcare facility. As soon as the code red mechanism 48 is depressed, the local display device 10A displays the word "EMERGENCY" (rather than the word "ROOM" as in a code blue or purple), prompting the healthcare administrator to optionally describe the emergency using the data entry device and, if relevant, input the location. Some emergencies, for example, might include: a bomb threat requiring evacuation; a violent person or patient; a hostage situation; a patient abduction; psychiatric situation; lost or disorderly elderly patient; or an overloaded emergency department. Then the local display device 5A sends an emergency code signal that corresponds to the selected code and sends the description of the emergency to each remote display device 10A (utilizing its unique identification code) worn a corresponding healthcare provider out of the plurality of healthcare providers. Upon receipt of the emergency code signal by each of the remote display devices 10A out of the plurality of remote display devices, each remote display device 10A instantly and silently displays on its LCD display screen 80 a code red emergency alert to the healthcare provider who is wearing the remote display device 10A. Preferably, the display of the code red emergency alert is accomplished by causing a peripheral area of the LCD display screen 80 to intermittently flash a bright red color, using a plurality of red LEDs, and by causing the textual description of the emergency to be constantly displayed in the center of the display. The code red will continue to flash and the textual description will continue to be displayed until the healthcare provider depresses the reset alert mechanism 85 or is automatically turned off after a predetermined time. In another embodiment, when the code red mechanism 88 is depressed, the plurality of remote display devices 10A will vibrate simultaneously with the code red flash and textual description, and will continue to vibrate until the reset alert mechanism 85 is depressed or will terminate after a predetermined time.

Figure 11:
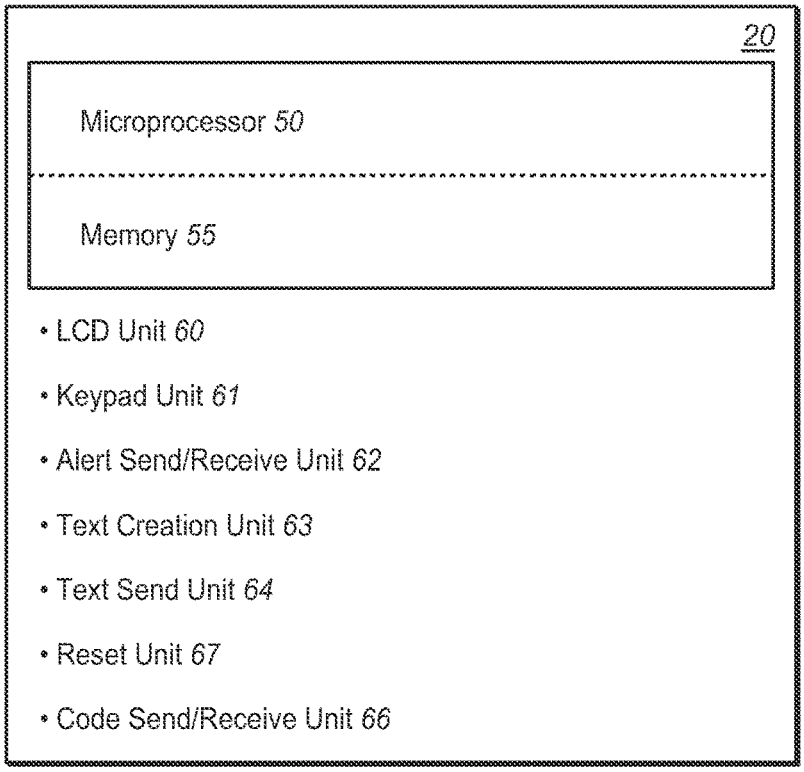
FIG. 11 presents a schematic diagram of the internal features of the local display device depicted in FIG. 9 and FIG. 10.

FIG. 11 illustrates the internal components of remote display device 5A that relate to the operation of the code blue mechanism 46, code purple mechanism 47 and code red mechanism 48. In this regard and as further illustrated in FIG. 11, the remote display device 5A has the same internal components as remote display device 5, but remote display device 5A also comprises a code send/receive unit 66 and the reset unit 67 with additional functionality. The code send/receive unit 66 within housing 70 of remote display device 5A is stored in memory 55 and activated by the microprocessor 50 to send code blue, purple and red emergency alerts to the plurality of remote display devices 5A being worn by a corresponding plurality of healthcare providers. When a code blue or a code purple emergency alert is initiated by a healthcare administrator by depressing a code blue or code purple mechanism, 87 or 88, the code send/receive unit 99: 1) causes LCD display screen 80 to prompt the healthcare administrator to use the data entry device 84 to enter the patient's room number; 2) generates an emergency code signal that is associated with the selected code, the room number and, for a code purple alert, any additional information relevant to selected code; and 3) sends the emergency code signal to the plurality of healthcare providers by addressing the emergency code signal to each remote display device 10A within the plurality of remote display devices 10A. If a code red emergency alert is initiated, the code send/receive unit 99: 1) uses LCD display screen 80 to prompt the healthcare administrator to use the data entry device 84 to describe the nature of the emergency and, if relevant, it's location; 2) generates an emergency code signal that is associated with the selected code and its description; and 3) sends the emergency code signal to the plurality of healthcare providers by addressing the emergency code signal to each remote display device 10A within the plurality of remote display devices 10A. The code send/receive unit 99 addresses the plurality of remote display devices 10A by obtaining from the memory 91 a plurality of identification codes associated with a corresponding plurality of remote display devices 10A. The emergency code signal sent by code send/receive unit 99 is received by a code send/receive unit 99 within each of the plurality of remote display devices 10A and is used to display the appropriate emergency alert and other information on the LCD display screen 80 of each remote display device 10A. And, the reset unit 67 has the additional function of returning a depressed code alert mechanism, 87, 88, or 89, to its non-depressed position.

In addition to being able to silently send emergency code alerts to the healthcare providers, the healthcare administrator, using local display device 5 or 5A, can also silently receive emergency code alerts from a healthcare provider, using a remote display 10A, with the emergency code alerts displayed on LCD display screen 30 of the local display device.

The portable alert communication system's ability to send silent emergency alerts to a plurality of remote display devices worn by corresponding plurality of healthcare providers represents a marked improvement over existing systems. As described in the Background Section, current systems rely on an audible system that is indiscriminately broadcast throughout the healthcare facility: potentially, and unnecessarily, alarming patients and their families. Current systems can also be very inefficient, if they work at all. Since HIPPA regulations preclude the emergency alerts from broadcasting the name and/or location of a patient experiencing a life threatening episode, the broadcast is very general and typically only identifies the floor where the patient is located. As a result, healthcare facility personnel must respond to the alert by, for example, proceeding to the elevators on the floor and verbally directing the responding healthcare providers to the patient's room. Even if the system works as intended, it is possible that some healthcare providers may arrive at the floor before the person assigned to give directions. This will result in the loss of critical seconds or worse before patient receives potentially lifesaving interventions. The present portable alert communication system overcomes these limitations by providing each healthcare provider, who is wearing a remote display device, to instantly and silently receive notice of the emergency alert and to be simultaneously notified of the patient's location. As a result, each healthcare provider can proceed directly to the patient's room without any loss of valuable time.

Educational Facility

Figure 12:
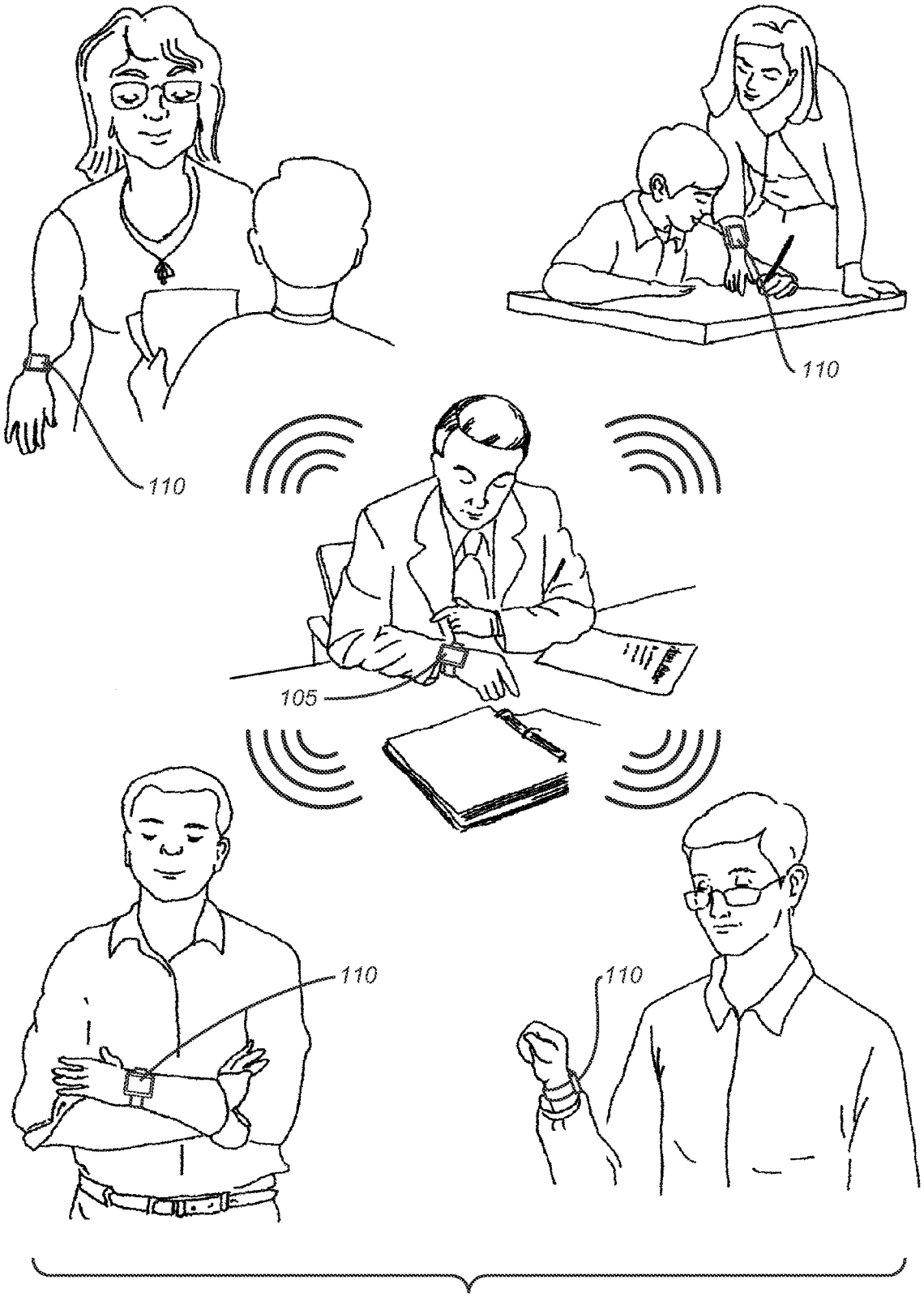
FIG. 12 presents a pictorial representation of a school administrator, who is wearing a local display device that can be being used to wirelessly communicate with a plurality of remote display devices worn by a corresponding plurality of school teachers.

In another embodiment, FIG. 12 illustrates a portable alert communication system for use in an educational facility, such as: a preschool; an elementary, middle or high school; or a university (hereinafter collectively referred to as a "school"). The portable alert communication system is comprised of a local display device 105 that can be used by a school administrator to communicate an alert to a plurality of teachers, each of whom are wearing a remote display device 110, concerning a threat to the physical well-being of the students and others at the school exists. The school administrator can normally be a person responsible for school security against threats to the physical well-being of students while on the school premises. The school teachers can typically include anyone at the school who has teaching or related responsibilities to students. Preferably, the local display device 105 can be worn on the wrist of the school administrator, and remote display device 110 can be worn on the wrist of each teacher out of the plurality of teachers. On the other hand, the local display device 105 also can be a display device that is not worn on the wrist of the school administrator; for example, the local display device 105 can be a desktop display device with the same functionality as the local display device 105. All communications would be transmitted as wireless communications using radio wave frequencies. In order to extend the reach of the wireless communication system between the school administrator operator and the plurality of teachers, a plurality of repeater booster routers can be provided within the school.

Figure 13A:
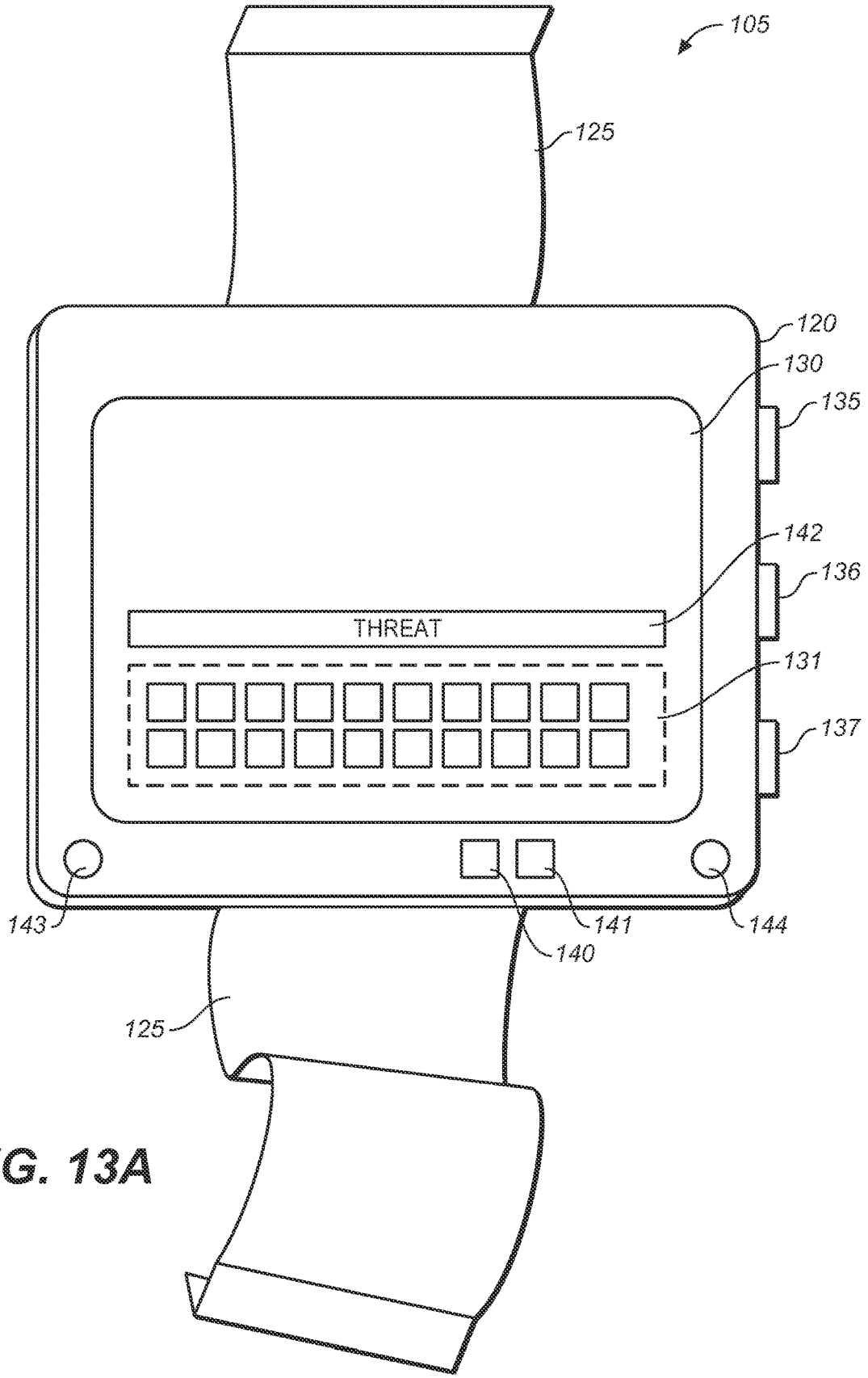
FIG. 13A presents a schematic diagram of the external features of the local display device depicted in FIG. 12.
Figure 13B:
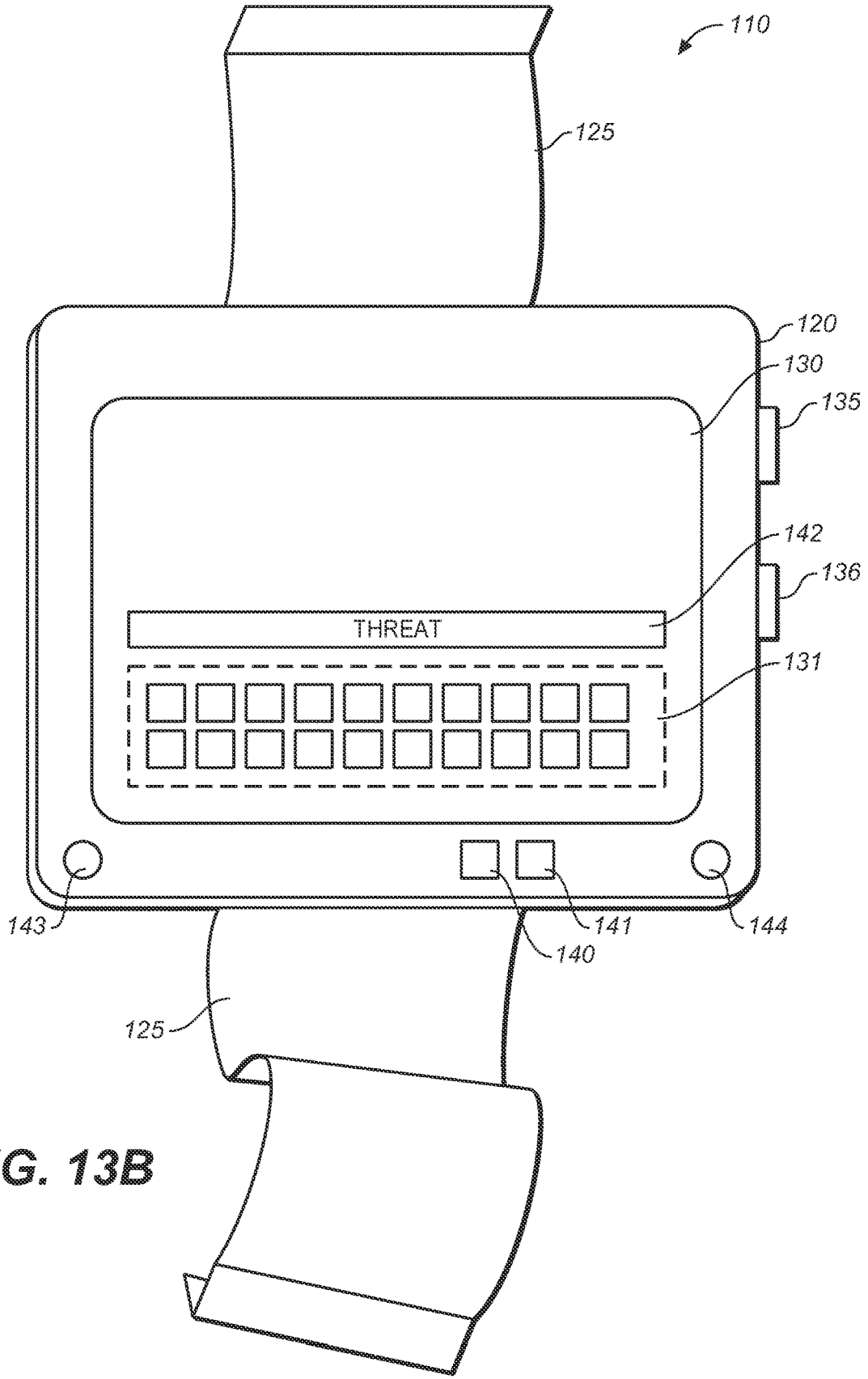
FIG. 13B presents a schematic diagram of the external features of the remote display device depicted in FIG. 12.

FIG. 13A presents a detailed illustration of the external features of the local display device 105 and FIG. 13B illustrates the external features of remote display device 110. As shown in FIG. 13A, the local display device 105 comprises a housing 120 and a wrist strap 125 attached to the housing 120, with the wrist strap 125 for securing the local display device 105 to the wrist of the school administrator. The wrist strap 125 can be of any type that is capable of securing the local display device 105 to the wrist; for example, a strap in two segments that are releasably attached by means of a hook and loop closure, buckle or clasp or, or the strap can be a single, expandable segment, such as an elastic band or spring loaded metal band, that fits snugly around the wrist. Other means of attaching the local display device 105 to the wrist will be apparent to those skilled in the art. In addition, the local display device 105 can be attached to a chain, similar to a watch fob, and worn around the neck or attached to an item of clothing. The housing 120 also comprises: an LCD display screen 130; a code blue mechanism 135, illuminated with a blue light emitting diode (LED); a code red mechanism 136, illuminated with a red LED; and a code green mechanism 137, illuminated with a green LED; a displayable data entry pad 131; a create text mechanism 140, a send text mechanism 141; a reset mechanism 143; and an ON/OFF mechanism 144. In a preferred embodiment, each of the code mechanisms can be a depressible button that remains in a down position when depressed and becomes temporarily not operable, and each of the other mechanisms can be depressible buttons that do not stay in a down position when depressed and remain operable.

With one exception, the external features of remote display device 110, as shown in FIG. 13B, are identical to the external features of local display device 105, with the only difference being that the remote display device 110 does not contain a code green mechanism.

In operation, the local display device 105 can be operated by the school administrator to send emergency alerts, such as code blue, code red or code green alerts, to the plurality of teachers. Code blue alerts can be sent when the school administrator becomes aware of a threat to the physical well-being of the students and others at the school that has arisen due to the presence of one or more unauthorized persons on the premises. For example, the threat could be that a person carrying a gun or other weapon is walking down a hallway at the school. When the school administrator becomes aware of a code blue type threat, the objective would be to immediately attempt to isolate the students and teachers from the threat while keeping them on the premises. The administrator can accomplish this objective by initiating a code blue alert by depressing the code blue alert mechanism 135 in order to instantly and silently advise each of the teachers that a threat exists. As soon as the code blue mechanism 135 is depressed, the local display device 105 sends an emergency code signal corresponding to the selected code, to a plurality of remote display devices 110 worn by a corresponding plurality of teachers. Upon receipt of the emergency code signal, each remote display device 110 instantly and silently displays an emergency code blue alert on each teacher's remote display device 110. Preferably, the display of the emergency code blue alert is accomplished by causing a peripheral area of the LCD display screen 130 to intermittently flash a bright blue color, using a plurality of blue LEDs. In another embodiment, when an emergency code signal is sent by the school administrator to a plurality of remote display devices 110 worn by a corresponding plurality of teachers, the remote display devices 110 will vibrate simultaneously with the code blue flash. When the school administrator determines that the threat no longer exists, the administrator can send an emergency cancelation alert to the teachers by depressing the code green mechanism 137, which causes the code blue to stop flashing and then causes the peripheral area of the LCD display screen 130 to intermittently flash a bright green color, using a plurality of green LEDs. Depressing the code green mechanism 137 also can cause the remote display device 110 to stop vibrating and return the code blue mechanism 135 to return to a non-depressed position. The code green will continue to flash until the school administrator depresses the reset mechanism 143 or the ON/OFF mechanism 144, which will also cause the code green mechanism 137 to return to a non-depressed position.

Code red alerts can be sent when the school administrator becomes aware of a threat to the physical well-being of the students and others at the school that does not constitute a code blue type threat. For example, the threat could be an environmental condition such as a fire or a chemical exposure on the school premises. When the school administrator becomes aware of a code red type threat, the objective would be to immediately remove the students and teachers from the threat by directing them to vacate the school building. The administrator can accomplish this objective by initiating a code red emergency alert by depressing the code red mechanism 136 in order to instantly and silently advise each of the teachers that a threat exists. As soon as the code red mechanism 136 is depressed, the local display device 105 sends an emergency code signal, corresponding to the selected code, to a plurality remote display devices 110 worn by a corresponding plurality of teachers. Upon receipt of the emergency code signal, each remote display device 110 instantly and silently displays a code red emergency alert on each teacher's remote display device 110. Preferably, the display of the code red emergency alert is accomplished by causing a peripheral area of the LCD display screen 130 to intermittently flash a bright red color, using a plurality of red LEDs. In another embodiment, when an emergency code signal is sent by the school administrator to the plurality of remote display devices 110 worn by the corresponding plurality of teachers, the remote display devices 110 will vibrate simultaneously with the code red flash. When the school administrator determines that the threat no longer exists, the administrator can send an emergency cancelation alert to the teachers by depressing the code green mechanism 137, which causes the code red to stop flashing and then causes the peripheral area of the LCD display screen 130 to intermittently flash a bright green color, using a plurality of green LEDs. Depressing the code green mechanism 137 also can cause the remote display device 110 to stop vibrating and return the code red mechanism 136 to return to a non-depressed position. The code green will continue to flash until the school administrator depresses the reset mechanism 143 or the ON/OFF mechanism 144, which will also cause the code green mechanism 137 to return to a non-depressed position.

In another embodiment, the school administrator can send a text message to the teachers pertaining to the code blue or code red emergency alert that has already been sent in order to more specifically describe the nature and status of the threat that led to the alert. For example, the school administrator might describe that there is a man with a gun on the second floor of the school or that the police are on the premises. To do so, the school administrator can use the create text mechanism 140 on the displayable data entry pad 131, causing a text box 142 to be displayed on the LCD display screen 130. The school administrator can then be prompted by a message appearing in the text box 142 to use the displayable data entry pad 131, or a keyboard if the local display device 105 operates with a keyboard, to enter within text box 142 the text message to be sent to a plurality of remote display devices 110 that are being worn by a corresponding plurality of teachers. The school administrator can then send the text message to the teachers by using the send text mechanism 141, which causes the text send unit 153 to create and send a text signal to the remote display devices 110. When the text signal is received, the remote display devices 10 display the text message to the teachers.

Figure 14A:
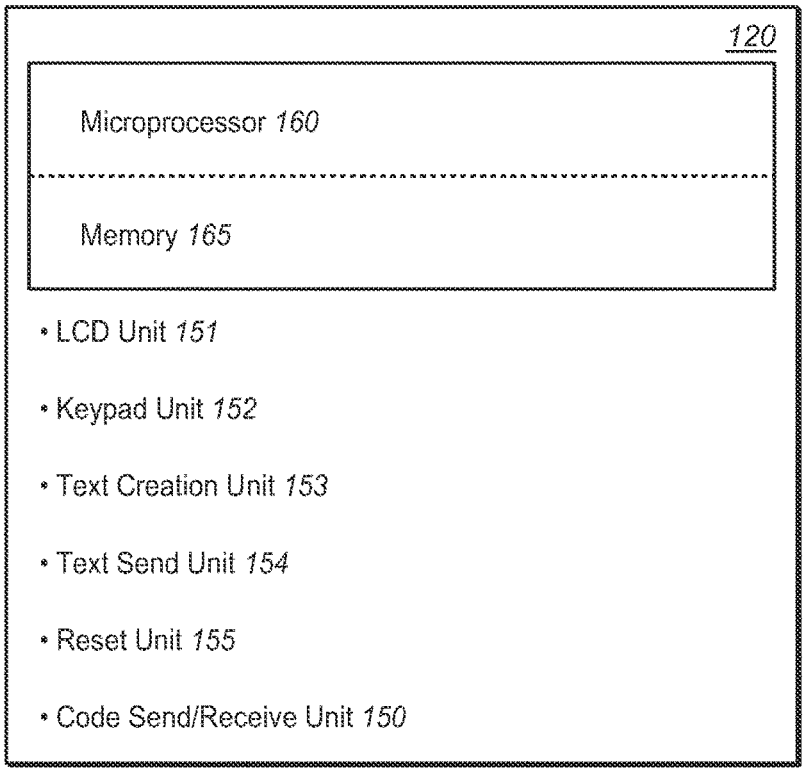
FIG. 14A presents a schematic diagram of the internal features of the local display device depicted in FIG. 12 and FIG. 13A

FIG. 14A illustrates the internal components of local display device 105 that are utilized to implement the functionality of external components of local display device 105, and FIG. 14 B describes the internal components of remote display device 110 that are utilized to implement the functionality of external components of local display device 110. Specifically, FIG. 14A shows the internal components within housing 120 of local display device 105 as comprising a microprocessor 160 and memory 165, with a code send/receive unit 150, an LCD unit 151, a keypad unit 152, a text creation unit 153, a text send unit 154, and a reset unit 155 all stored in the memory 165 that is accessible to the microprocessor 160. When battery power is supplied to the microprocessor 160 utilizing the ON/OF mechanism 144, the microprocessor 160 uses the LCD unit 151 to activate the LCD display screen 130, the keypad unit 152 to activate the displayable data entry pad 131, and activates all of the other internal components. As noted above, the school administrator can initiate the communication of a code blue, code red or code green alert to a plurality of teachers by depressing the code blue mechanism 135, code red mechanism 136 or code green mechanism 137, respectively. This action causes the code send/receive unit 150 to generate an emergency code signal corresponding to the code mechanism that has been depressed and sends the emergency code signal to the teachers by addressing the signal to each remote display device 110 worn by a teacher. The code send/receive unit 150 addresses the remote display devices 110 by obtaining from the memory 145 a plurality of identification codes associated with a corresponding plurality of remote display devices 110 worn by a corresponding plurality of teachers. When the code signal is received by the remote display device 110 to which it was addressed the signal can be used to display the appropriate emergency alert, blue, red or green, on the remote display device 110 worn by the teacher.

Figure 14B:
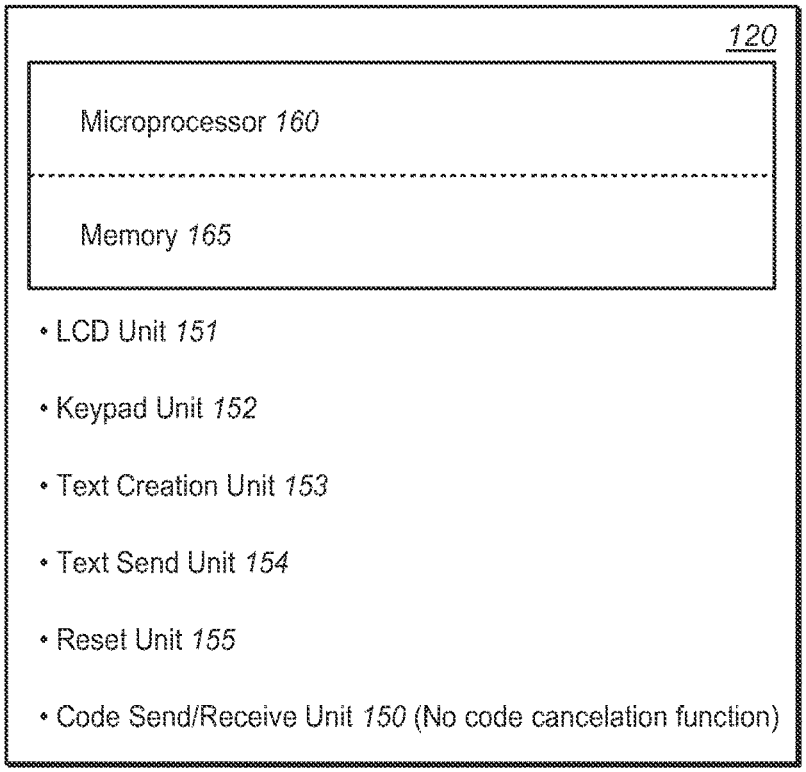
FIG. 14B presents a schematic diagram of the internal features of the remote display device depicted in FIG. 12 and FIG. 13B

With one exception, the internal features of remote display device 110, as shown in FIG. 14B, are identical to the internal features of local display device 105, with the only difference being that the code send/receive unit 150 within remote display device 110 is not programmed to process code green signals. As discussed below, only school administrators are given the ability to cancel an emergency alert. In order for the plurality of teachers, each of whom are wearing an remote display device 110, to receive a code signal from the local display device 105, each remote display device 110 is activated by depressing the ON/OFF mechanism 144. This action causes battery power to be supplied to the microprocessor 160, which activates the internal components of the remote display device 110, including the code send/receive unit 150 which, in turn, uses the code signal to display the appropriate code alert on the LCD display screen 130, and uses any subsequent text signal to display a text message on the LCD display screen 130, preferably located within the periphery of the flashing code alert.

Figure 15:
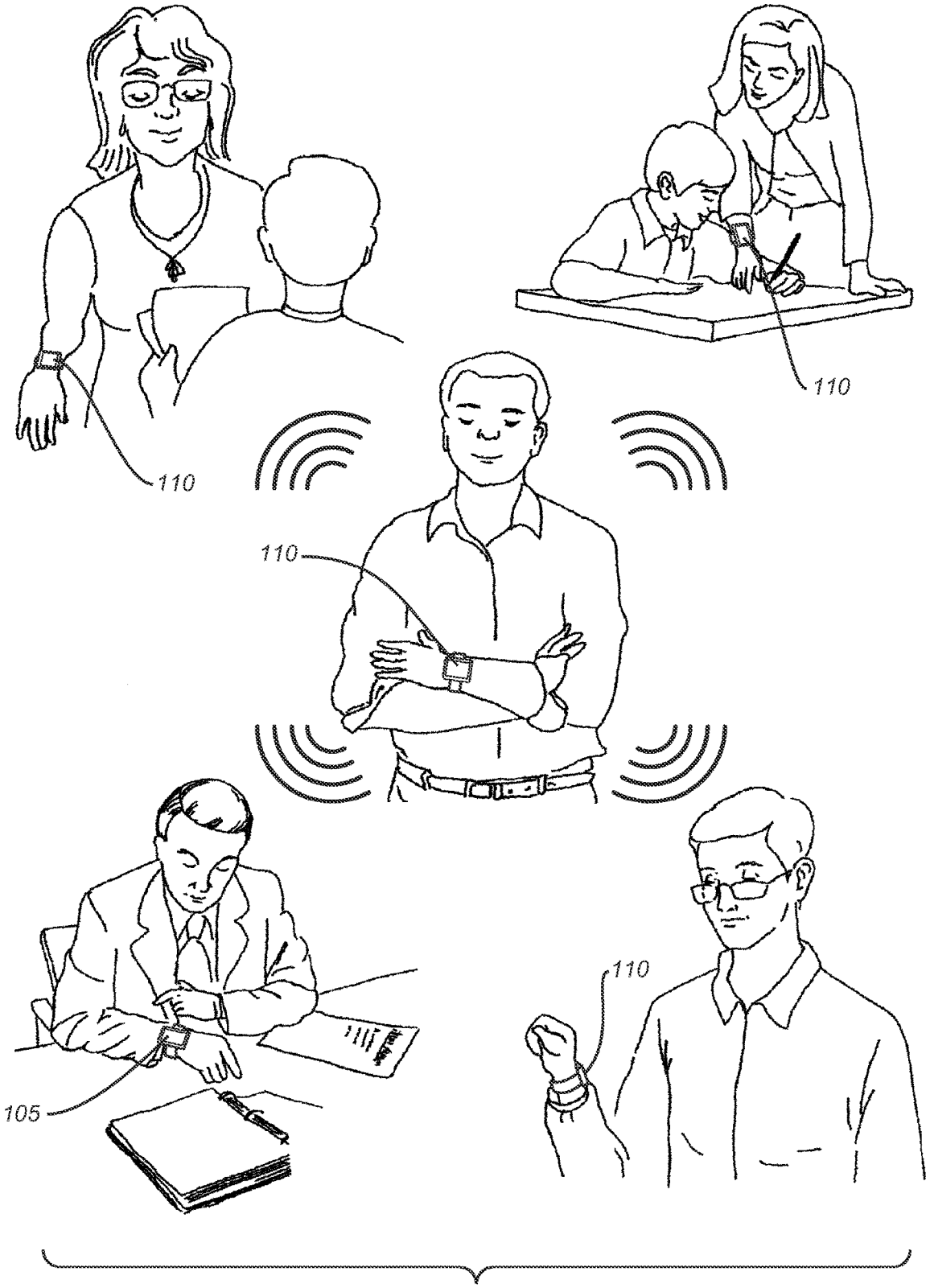
FIG. 15 presents a pictorial representation of a teacher, who is wearing the remote display device depicted in FIG. 13B that can be being used to wirelessly communicate with a plurality of other remote display devices worn by a corresponding plurality of school teachers and to communicate with the local display device depicted in FIG. 13A.

In addition to enabling a school administrator to initiate a code blue or code red emergency alert, the portable alert communication alert system includes the feature of enabling a teacher out of the plurality of teachers to initiate an alert. As illustrated in FIG. 15, a teacher who is wearing a remote display device 110 can initiate a code blue or code red emergency alert in the same manner as the school administrator wearing a local display device 105. Specifically, the remote display device 110 can be operated by a teacher to send a code blue or code red emergency alert to the school administration and to the other teachers. In this case, code blue emergency alerts can be sent when a teacher becomes aware of a threat to the physical well-being of the students and others at the school that has arisen due to the presence of one or more unauthorized persons on the school premises. For example, the threat could be that a person carrying a gun or other weapon is walking down a hallway at the school. When the teacher becomes aware of a code blue type threat, the objective would be to immediately attempt to isolate the students and teachers from the threat while keeping them on the premises. The teacher can accomplish this objective by initiating a code blue emergency alert by depressing the code blue mechanism 135 on remote display device 110 in order to instantly and silently advise each of the teachers and the school administrator that a threat exists. As soon as the code blue mechanism 135 is depressed, the remote display device 110 sends a code blue signal to each of the portable stations 110 worn by a teacher and to the local display device 105 worn by the school administrator. Upon receipt of the code blue signal, each teacher's remote display device 110 and the administrator's local display device 105 instantly and silently displays a code blue emergency alert on the portable stations. Preferably, the display of the code blue emergency alert is accomplished by causing a peripheral area of the LCD display screen 130 on each teacher's remote display device 110 and on the school administrator's local display device 105 to intermittently flash a bright blue color, using a plurality of blue LEDs. In another embodiment, when a code blue signal is sent by the teacher to each of the remote display devices 110 worn by a teacher and to local display device 105 worn by the school administration, the portable stations will vibrate simultaneously with the code blue flash, and will continue to vibrate for a predetermined time or until the reset mechanism 143 is depressed. The determination of whether the emergency condition no longer exists can be made by the school administrator. If that determination is made, the administrator can send an emergency cancelation alert to the teachers by depressing the code green mechanism 137 on his or her local display device 105. This action causes the code blue to stop flashing on the administrator's local display device 105 and on each teacher's remote display device 110, and then causes the peripheral area of the LCD display screen 130 on the administrator's local display device 105 and on each teacher's remote display device 110 to use a plurality of green LEDs to intermittently flash a bright green color, signaling that the emergency no longer exists. The reset mechanism 143 on local display device 105 and on each remote display device 110 can be used by the school administrator and each teacher, respectively, to turn off the flashing code green and return any depressed mechanisms to a non-depressed position.

Code red alerts can be sent when a teacher becomes aware of a threat to the physical well-being of the students and others at the school that does not constitute a code blue threat. For example, the threat could be an environmental condition such as a fire or a chemical exposure on the school premises. When the teacher becomes aware of a code red type threat, the objective would be to immediately remove the students and teachers from the threat by directing them to vacate the building. The teacher can accomplish this objective by initiating a code red emergency alert by depressing the code red mechanism 136 on remote display device 110 in order to instantly and silently advise each of the teachers that a threat exists. As soon as the code red mechanism 136 is depressed, the remote display device 110 sends a code red signal to each of the other remote display devices 110 worn by a teacher and to the local display device 105 worn by the school administrator. Upon receipt of the code red signal, each remote display device 110 worn by a teacher and the local display device 105 worn by the administration instantly and silently displays a code red emergency alert on portable station. Preferably, the display of the code red emergency alert is accomplished by causing a peripheral area of the LCD display screen 130 on each teacher's remote display device 110 and on the school administrator's local display device 105 to intermittently flash a bright red color, using a plurality of red LEDs. In another embodiment, when a code red signal is sent to each of the remote display devices 110 worn by a teacher and to the local display device 105 worn by the school administrator, the portable stations will vibrate simultaneously with the code red flash, and will continue to vibrate for a predetermined time or until the reset mechanism 143 is depressed by the teacher. The determination of whether the emergency condition no longer exists can be made by the school administrator. If that determination is made, the administrator can send an emergency cancelation alert to the teachers by depressing the code green mechanism 137 on his or her local display device 105. This action causes the code red to stop flashing on the administrator's local display device 105 and on each teacher's remote display device 110, and then causes the peripheral area of the LCD display screen 130 on the administrator's local display device 105 and on each teacher's remote display device 110 to use a plurality of green LEDs to intermittently flash a bright green color, signaling that the emergency no longer exist. The reset mechanism 143 on local display device 105 and on each remote display device 110 can be used by the school administrator and each teacher, respectively, to turn off the flashing code green and return any depressed mechanisms to a non-depressed position.

In another embodiment, a teacher can send a text message to the school administrator and to the other teachers pertaining to the code blue or code red emergency alert that has already been sent in order to more specifically describe the nature and status of the threat that led to the emergency alert. For example, a teacher might describe that there is a man with a gun on the second floor of the school or that the police are on the premises. To do so, the teacher can use the create text mechanism 140 to cause a text box 142 to be displayed on the LCD display screen 130. The teacher can then be prompted by a message appearing in the text box 142 to use the displayable data entry pad 131 to enter within text box 142 the text message to be sent to a plurality of remote display devices 110 that are being worn by a corresponding plurality of teachers and to the school administrator. The teacher can then send the text message to the teachers and the school administrator by using the send text mechanism 141, which causes the text send units 153 and 154 to create and send a text signal to the other teachers' remote display devices 110 and to the school administrator's local display device 105. When the text signal is received, the remote display devices 110 and local display device 105 displays the text message to the teachers and school administrator, respectively.

Schools can implement any protocols they deem to be appropriate when a code blue or code red emergency alert is issued. However, when a code blue alert is issued, it is again suggested that teachers, who are in a classroom with their students, would be expected to immediately lockdown the classroom with their students inside and preferably under their desks. The teacher would perform the lockdown by utilizing whatever type of door and window locking mechanisms are made available by the school. In this manner, the students would be potentially isolated from the threat that exists outside the classroom. On the other hand when a code red alert is issued, it is suggested that the teachers, wherever they are located within the school, would be expected to immediately to direct the students within their care to exit the building. The lockdown and exit conditions would continue until the school administrator determines that the threat no longer exists and depresses the code green mechanism 137 on local display device 105, causing the plurality of auxiliary of stations 110 worn by the corresponding plurality of teachers to display a flashing green screen that replaces the flashing blue or red screen.

The portable alert communication system for use in an educational facility overcomes several of the limitations in a public address system that can be used by a school administrator to alert teachers and students of a life threatening emergency. One of those limitations is that the school administrator, who has access to the public address system, may not learn of the emergency until a substantial amount of harm has been inflicted on the teachers and students. Another limitation is that a broadcast of the potential threat to the entire school population may create and unnecessary panic among students, impairing the ability of the teachers to implement procedures to protect the students.

The present portable alert communication system overcomes those limitations by enabling a school administrator, wearing a local display device, who happens to be the first person to become aware of a threat to the students' safety to use the device to issue a silent emergency alert to all persons wearing a remote display device. Those other persons could then implement protective measures without any unnecessary delay. And, since the emergency alert is transmitted silently, the potential for panic among the students is largely eliminated. The system also includes the feature of enabling a teacher, wearing a remote display device, to initiate the silent emergency alert to the school administrator, wearing a local display device, and to all other persons wearing a remote display device. Additionally, Although the portable alert communication system has been described above in connection with its use in an educational facility, it will be readily apparent to those persons skilled in the art of alert communication systems that the portable alert communication system could also be used in other facilities. For example, the portable alert communication system could be utilized in a business facility for use by a business administrator operating a local display device and business employees operating remote display devices. In this regard, although a preferred embodiment and other embodiments have been described, it will be recognized by those skilled in the art that other embodiments and features may be provided without departing from the underlying principals of those embodiments. The scope of the invention is defined by appended claims.

The invention claimed is:

1. A portable alert communication system for use in a healthcare facility, comprising:

a local display device for use by a healthcare administrator person who has assessed the healthcare needs of a patient and decided to issue a level-of-care alert relating to a non-life-threatening healthcare need of the patient;

at least one portable remote display device in communication with the local display device, with the at least one portable remote display device for use by a healthcare provider person in order to receive the level-of-care alert;

at least one depressible level-of-care mechanism integral with the local display device, with the at least one depressible level-of-care mechanism for operation by the healthcare administrator person in sending a level-of-care signal to the at least one portable remote display device, and with the level-of-care signal for use by the at least one portable remote display device in displaying the level-of-care alert, relating to the non-life-threatening healthcare need of the patient, to the healthcare provider person;

a display screen integral with the local display device, with the display screen for use by the healthcare administrator person in entering an identification code for addressing the level-of-care signal to be sent to the at least one portable remote display device;

an acknowledgment indicator integral with the local display device, with the acknowledgment indicator for use in displaying an acknowledgment response relating to an acknowledgment signal received from the at least one portable remote display device;

a level-of-care indicator integral with the portable remote display device, with the level-of-care indicator for use in displaying the level-of-care alert received by the at least one portable remote display device from the local display device, with the level-of care alert displayed as an illuminated light having a predetermined color; and an acknowledgment mechanism integral with the at least one portable remote display device, with the acknowledgment mechanism for use by the healthcare provider person in sending the acknowledgment signal to the local display device, and with the acknowledgment signal for use by the local display device in displaying the acknowledgment response indicating whether the healthcare provider person can attend to the non-life-threatening healthcare need of the patient; and whereby the healthcare administrator person uses the local display device to send the level-of-care alert relating to the non-life-threatening healthcare need of a patient to the at least one portable remote display device, which displays the level-of-care alert to the healthcare provider person, who then sends the acknowledgment response to the local display device, which displays the acknowledgment response to the healthcare administrator person, indicating whether the healthcare provider person accepts or declines the healthcare administrator person's request to attend to the non-life-threatening healthcare need of the patient;

in which the local display device has a strap for attaching the local display device to the body of the healthcare administrator person.

2. The portable alert communication system of claim 1 in which the at least one portable remote display device has a strap for attaching the at least one portable remote display device to the body of the healthcare provider person.

3. The portable alert communication system of claim 1, with the display screen, integral with the local display device, for displaying a keypad for use by the healthcare administrator person in sending a text message to the at least one portable remote display device.

4. The portable alert communication system of claim 1, with the local display device in communication with a keyboard for use by the healthcare administrator person in sending a text message to the at least one portable remote display device.

5. The portable alert communication system of claim 1 in which the at least one level-of-care mechanism integral with the local display device comprises three level-of-care mechanisms.

6. The portable alert communication system of claim 1 in which the at least one portable remote display device further comprises a vibrator for use in vibrating the at least one portable remote display device when the level-of-care signal is received from the local display device.

7. The portable alert communication system of claim 1 in which the at least one portable remote display device also comprises a display screen for use in displaying a text message relating to the level-of-care alert that can be sent by the healthcare administrator person using the local display device to the at least one portable remote display device.

8. The portable alert communication system of claim 1 in which the at least one portable remote display device also comprises at least one emergency code depressible mechanism for use by a healthcare provider person who has assessed the healthcare needs of a patient and decided to send an emergency alert, relating to a life threatening healthcare need of the patient, to another portable remote display device.

9. The portable alert communication system of claim 1 in which the at least one portable remote display device also comprises at least one emergency code depressible mechanism for use by a healthcare provider person who has assessed the healthcare needs of a patient and decided to send an emergency alert, relating to a life threatening healthcare need of the patient, to the local display device.

10. The portable alert communication system of claim 1 in which the at least one portable remote display device also comprises a display screen for use in displaying an emergency alert received from another portable remote display device.

11. The portable alert communication system of claim 1 in which the at least one portable remote display device also comprises a display screen for use in displaying an emergency alert received from the local display device.

12. The portable alert communication system of claim 1 in which the local display device also comprises at least one depressible emergency code mechanism for use by the healthcare administrator person in sending an emergency alert, not relating to the healthcare needs of a patient, to the at least one portable remote display device.

13. The portable alert communication system of claim 12 in which the display screen integral with the local display device is for use in displaying an emergency alert received from the at least one portable remote display device.

* * * * *